US011760105B2

(12) United States Patent
Kubota

(10) Patent No.: US 11,760,105 B2
(45) Date of Patent: Sep. 19, 2023

(54) HEAD CHIP, LIQUID JET HEAD, AND LIQUID JET RECORDING DEVICE

(71) Applicant: SII Printek Inc., Chiba (JP)

(72) Inventor: Yuzuru Kubota, Chiba (JP)

(73) Assignee: SII PRINTEK INC., Chiba (JP)

( * ) Notice: Subject to any disclaimer, the term of this patent is extended or adjusted under 35 U.S.C. 154(b) by 26 days.

(21) Appl. No.: 17/552,686

(22) Filed: Dec. 16, 2021

(65) Prior Publication Data

US 2022/0194091 A1 Jun. 23, 2022

(30) Foreign Application Priority Data

Dec. 21, 2020 (JP) ..... 2020-211236

(51) Int. Cl.
*B41J 2/18* (2006.01)
*B41J 2/14* (2006.01)

(52) U.S. Cl.
CPC ..... *B41J 2/18* (2013.01); *B41J 2/14201* (2013.01)

(58) Field of Classification Search
CPC ..... B41J 2/1609; B41J 2/1623; B41J 2/1632; B41J 2/14209; B41J 2/1626; B41J 2/1635; B41J 2/1631; B41J 2/1642; B41J 2/1643; B41J 2/17509; B41J 2/14201; B41J 2/1433; B41J 2/18; B41J 2/1607; B41J 2002/14419; B41J 2202/12; B41J 2002/14491
See application file for complete search history.

(56) References Cited

U.S. PATENT DOCUMENTS

| | | | | |
|---|---|---|---|---|
| 5,835,110 | A | 11/1998 | Sasaki | |
| 9,610,769 | B2 * | 4/2017 | Kubota | B41J 2/14209 |
| 10,654,271 | B2 * | 5/2020 | Yamamura | B41J 2/1433 |
| 10,717,280 | B2 * | 7/2020 | Nishikawa | B41J 2/14209 |
| 2003/0016256 | A1 | 1/2003 | Harvey et al. | |

FOREIGN PATENT DOCUMENTS

| | | | |
|---|---|---|---|
| EP | 1923219 | A2 | 5/2008 |
| JP | 2007-075998 | A | 3/2007 |
| JP | 2010-30314 | A | 2/2010 |
| JP | 2014-177076 | A | 9/2014 |
| JP | 2015-171801 | A | 10/2015 |
| JP | 2016-107418 | A | 6/2016 |

OTHER PUBLICATIONS

Corrected European Search Report in Europe Application No. 21216169.9, dated Nov. 2, 2022, 33 pages.
Corrected European Search Opinion in Europe Application No. 21216169.9, dated Nov. 15, 2022, 5 pages.
Extended European Search Report in Europe Application No. 21216169.9, dated May 13, 2022, 8 pages.

* cited by examiner

*Primary Examiner* — An H Do
(74) *Attorney, Agent, or Firm* — Crowell & Moring LLP

(57) ABSTRACT

There are provided a head chip, a liquid jet head, and a liquid jet recording device each capable of ensuring sufficient ejection pressure. The head chip according to an aspect of the present disclosure is provided with an actuator plate provided with first ejection channels and second ejection channels, and a feedback plate disposed on a lower end surface of the actuator plate. The first ejection channels are each surrounded by a pair of upstream drive walls opposed to each other in an X direction. The second ejection channels are each surrounded by a pair of downstream drive walls opposed to each other in the X direction.

11 Claims, 17 Drawing Sheets

HEAD CHIP, LIQUID JET HEAD, AND LIQUID JET RECORDING DEVICE

RELATED APPLICATIONS

This application claims priority to Japanese Patent Application No. 2020-211236, filed on Dec. 21, 2020, the entire content of which is incorporated herein by reference.

BACKGROUND OF THE INVENTION

1. Field of the Invention

The present disclosure relates to a head chip, a liquid jet head, and a liquid jet recording device.

2. Description of the Related Art

An inkjet head to be installed in an inkjet printer ejects ink to a recording target medium through a head chip installed in the inkjet head. The head chip is provided with an actuator plate provided with ejection channels and non-ejection channels, and a nozzle plate provided with nozzle holes communicated with the ejection channels. The ejection channels and the non-ejection channels are alternately arranged across respective drive walls.

In the head chip, in order to eject the ink, a voltage is applied between electrodes provided to the drive wall to cause the drive wall to make a thickness-shear deformation. Thus, due to a change in volume of the ejection channel, the ink in the ejection channel is ejected through the nozzle hole.

For example, in JP-A-2010-30314 (Patent Literature 1), there is disclosed a so-called circulation type head chip in which the ink is circulated between a pair of ejection channels disposed at both sides of one non-ejection channel. Specifically, in the head chip described in Patent Literature 1, a feedback channel for communicating the pair of ejection channels and the nozzle hole with each other is disposed between the actuator plate and the nozzle plate. According to this configuration, by propagation of the pressure fluctuation in the ejection channel due to the deformation of the drive wall to the ink circulating through the feedback channel, the ink circulating through the feedback channel is ejected through the nozzle hole.

However, in the head chip in Patent Literature 1 described above, there is adopted a configuration in which only a portion partitioning the pair of ejection channels and a non-ejection channel functions as the drive wall. In other words, in the head chip described in Patent Literature 1, since the drive wall is only provided to one side of one of the ejection channels, there is a limitation in a volume variation in the ejection channel when ejecting the ink. Therefore, in the head chip of the related art, a room for improvement still exists in the point of ensuring the sufficient ejection pressure.

SUMMARY OF THE INVENTION

The present disclosure provides a head chip, a liquid jet head, and a liquid jet recording device each capable of ensuring the sufficient ejection pressure.

In view of the problems described above, the present disclosure adopts the following aspects.

(1) A head chip according to an aspect of the present disclosure includes an actuator plate provided with a first jet channel and a second jet channel which are arranged at an interval in a first direction, and which open on an end surface facing to one side in a second direction crossing the first direction, and an end member which is disposed on the end surface of the actuator plate, and which has a coupling channel configured to couple the first jet channel and the second jet channel to each other and a jet orifice configured to communicate an inside and an outside of the coupling channel with each other, wherein the first jet channel is surrounded by a pair of first drive walls which are opposed to each other in the first direction, and which deform so as to expand or contract the first jet channel, and the second jet channel is surrounded by a pair of second drive walls which are opposed to each other in the first direction, and which deform so as to expand or contract the second jet channel.

According to the present aspect, the first jet channel and the second jet channel located at both side across the coupling channel are each surrounded by a pair of drive walls. When jetting the liquid, by deforming each of the first drive wall and the second drive wall, it is possible to increase the volume variation in the liquid channel (a flow channel from the first jet channel to the second jet channel via the coupling channel). As a result, it is possible to generate a high pressure wave to the liquid in the liquid flow channel. Therefore, it is possible to ensure the sufficient jet pressure of the liquid.

(2) In the head chip according to the aspect (1) described above, it is preferable that the actuator plate is provided with a first non jet channel which is located at an opposite side to the second jet channel with respect to the first jet channel, and which extends in the second direction, a second non-jet channel which is located between the first jet channel and the second jet channel, and which extends in the second direction, and a third non-jet channel which is located at an opposite side to the first jet channel with respect to the second jet channel, and which extends in the second direction, one of the pair of first drive walls is a portion located between the first jet channel and the first non-jet channel, another of the pair of first drive walls is a portion located between the first jet channel and the second non jet channel, one of the pair of second drive walls is a portion located between the second jet channel and the second non-jet channel, and another of the pair of second drive walls is a portion located between the second jet channel and the third non jet channel.

According to the present aspect, by forming the non-jet channel between the jet channels, the drive wall is formed in a portion surrounded by the jet channel and the non-jet channel. Thus, it is possible to easily form the drive walls at both sides of each of the jet channels.

(3) In the head chip according to the aspect (2) described above, it is preferable that the first non-jet channel, the second non-jet channel, and the third non-jet channel open on the end surface of the actuator plate, and the end member is provided with a closure part configured to cover the first non-jet channel, the second non-jet channel, and the third non jet channel.

According to the present aspect, by covering the opening part on the end surface of the actuator plate in the non-jet channel with the end part, it is possible to extend the drive walls up to the end surface. Thus, it is easy to effectively propagate the jet pressure of the liquid to the jet orifice.

(4) In the head chip according to any of the aspects (1) through (3) described above, it is preferable that defining a direction crossing the first direction when viewed from the second direction as a thickness direction of the actuator plate, the first jet channel opens at least on a first principal surface in the thickness direction in the actuator plate, the second jet channel opens at least on a second principal surface in the thickness direction in the actuator plate, a first cover plate provided with a first liquid flow channel communicated with the first jet channel is disposed at a side of the first principal surface of the actuator plate, and a second cover plate provided with a second liquid flow channel communicated with the second jet channel is disposed at a side of the second principal surface of the actuator plate.

According to the present aspect, by the first jet channel and the second jet channel opening at least on the principal surfaces different from each other of the actuator plate, it becomes possible to dispose the cover plates respectively at the both sides in the thickness direction with respect to the actuator plate. Thus, it is possible to achieve simplification of the configuration compared to a single cover plate provided with the first liquid flow channel and the second liquid flow channel.

(5) In the head chip according to the aspect (4) described above, it is preferable that the actuator plate is provided with a tail part located at another side in the second direction with respect to the first jet channel, the second jet channel penetrates the actuator plate in the thickness direction, and the actuator plate is provided with a first wiring section formed over an inner surface of the first jet channel and the first principal surface in the tail part, and a second wiring section formed over an inner surface of the second jet channel and the first principal surface in the tail part.

According to the present aspect, it is possible to couple the wiring section corresponding to each of the jet channels to the external wiring at a side of the first principal surface of the actuator plate. Thus, it is possible to achieve the simplification of the configuration.

(6) In the head chip according to the aspect (5) described above, it is preferable that a surface exposed at one side in the second direction of an inner surface of the first jet channel is provided with a first guide surface which constitutes a part of an opening edge of the first jet channel on the first principal surface, and which extends toward the one side in the second direction along a direction toward the second principal surface in the thickness direction, a surface exposed at the one side in the second direction of an inner surface of the second jet channel is provided with a second guide surface which extends toward the one side in the second direction along a direction toward the first principal surface in the thickness direction, and an inclined surface which extends toward another side in the second direction along a direction toward the first principal surface in the thickness direction, and which constitutes a part of an opening edge of the second jet channel on the first principal surface, the first wiring section includes a first opposed electrode formed on inner side surfaces opposed to each other in the first direction in the inner surface of the first jet channel, a first terminal formed on the first principal surface in the tail part, and a first coupling part which is formed on the first guide surface, and which is configured to electrically couple the first opposed electrode and the first terminal to each other, and the second wiring section includes a second opposed electrode formed on inner side surfaces opposed to each other in the first direction in the inner surface of the second jet channel, a second terminal formed on the first principal surface in the tail part, and a second coupling part which is formed on the inclined surface, and which is configured to electrically couple the second opposed electrode and the second terminal to each other.

According to the present aspect, when defining, for example, the first liquid flow channel as an entrance side flow channel, and the second liquid flow channel as an exit side flow channel, the liquid having flowed into the first jet channel from the first liquid flow channel flows smoothly toward the end member (the coupling channel) along the first guide surface. Meanwhile, the liquid having flowed into the second jet channel from the coupling channel smoothly flows toward the second liquid flow channel along the second guide surface. Thus, it is possible to reduce the pressure loss in the jet channel to efficiently circulate the liquid in the liquid channel.

Moreover, in the present aspect, the first guide surface of the first jet channel is exposed at the first principal surface side through the opening part of the first jet channel, and the inclined surface of the second jet channel is exposed at the first principal surface side through the opening part of the second jet channel. Thus, when supplying an electrode material of the first wiring section and the second wiring section to the inside of each of the jet channels through the opening part at the first principal surface side, it is possible to effectively deposit the electrode material of the first wiring section on the first guide surface, and at the same time, it is possible to effectively deposit the electrode material of the second wiring section on the inclined surface. Thus, it is possible to ensure the electrical coupling between the opposed electrode and the terminal part.

(7) A head chip according to an aspect of the present disclosure includes an actuator plate provided with a first jet channel and a second jet channel which are arranged at an interval in a first direction, and which open on an end surface facing to one side in a second direction crossing the first direction, and an end member which is disposed on the end surface of the actuator plate, and which has a coupling channel configured to couple the first jet channel and the second jet channel to each other and a jet orifice configured to communicate an inside and an outside of the coupling channel with each other, wherein the first jet channel opens at least on a first principal surface of the actuator plate in a thickness direction crossing the second direction when viewed from the first direction, and is provided with a first guide surface which is disposed on a surface exposed at one side in the second direction, which constitutes a part of an opening edge of the first jet channel on the first principal surface, and which extends toward the one side in the second direction along a direction toward a second principal surface in the thickness direction, the second jet channel opens at least on the second principal surface in the thickness direction of the actuator plate, and is provided with a second guide surface which is disposed on a surface exposed at the one side in the second direction, and which extends toward the one side in the second direction along a direction toward the first principal surface in the thickness direction, a first cover plate provided with a first liquid flow channel which is formed at a position opposed to the first guide surface in the thickness direction, and which is communicated with the first jet channel is disposed at a side of the first principal surface of the actuator plate, and a second cover plate provided with a second liquid flow channel which is formed at a position opposed to the second guide surface in the thickness direction, and which is communicated with the second jet channel is disposed at a side of the second principal surface of the actuator plate.

According to the present aspect, when defining, for example, the first liquid flow channel as an entrance side flow channel, and the second liquid flow channel as an exit side flow channel, the liquid having flowed into the first jet channel from the first liquid flow channel flows smoothly toward the end member (the coupling channel) along the first guide surface. Meanwhile, the ink having flowed into the second jet channel from the coupling channel smoothly flows toward the second liquid flow channel along the second guide surface. Thus, it is possible to reduce the pressure loss in the jet channel to efficiently circulate the liquid in the liquid channel.

(8) A liquid jet head according to an aspect of the present disclosure includes the head chip according to any of the aspects (1) through (7) described above.

According to the present aspect, it is possible to provide a liquid jet head which ensures the sufficient ejection pressure and is high in performance.

(9) A liquid jet recording device according to an aspect of the present disclosure includes the liquid jet head according to the aspect (8) described above.

According to the present aspect, it is possible to provide a liquid jet recording device which ensures the sufficient ejection pressure and is high in performance.

According to an aspect of the present disclosure, it is possible to provide the head chip, the liquid jet head, and the liquid jet recording device each capable of ensuring the sufficient ejection pressure.

DETAILED DESCRIPTION OF THE PREFERRED EMBODIMENTS

Figure 1:
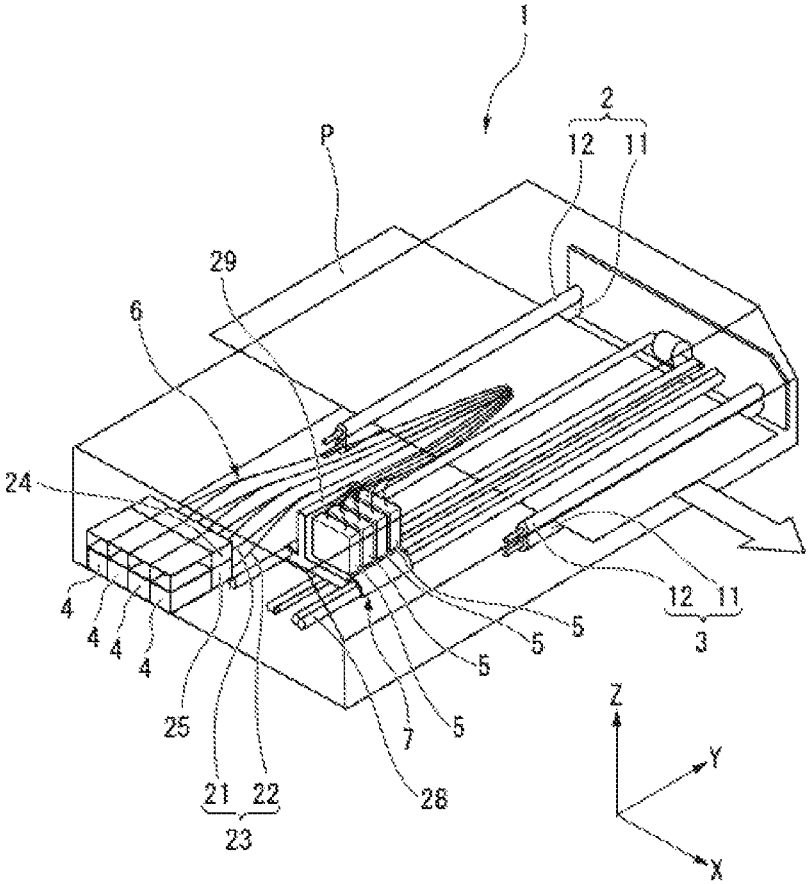
FIG. 1 is a schematic configuration diagram of an inkjet printer according to an embodiment.

An embodiment according to the present disclosure will hereinafter be described with reference to the drawings. In the embodiment and a modified example described hereinafter, constituents corresponding to each other are denoted by the same reference symbols and the description thereof will be omitted in some cases. It should be noted that in the following description, expressions representing relative or absolute arrangement such as "parallel," "perpendicular," "center," and "coaxial" not only represent strictly such an arrangement, but also represent the state of being relatively displaced with a tolerance, or an angle or a distance to the extent that the same function can be obtained. In the following embodiment, the description will be presented citing an inkjet printer (hereinafter simply referred to as a printer) for performing recording on a recording target medium using ink (liquid) as an example. It should be noted that the scale size of each member is arbitrarily modified so as to provide a recognizable size to the member in the drawings used in the following description.

Printer 1

FIG. 1 is a schematic configuration diagram of a printer 1.

As shown in FIG. 1, the printer (a liquid jet recording device) 1 according to the present embodiment is provided with a pair of conveying mechanisms 2, 3, ink tanks 4, inkjet heads (liquid jet heads) 5, ink circulation mechanisms 6, and a scanning mechanism 7.

In the following explanation, the description is presented using an orthogonal coordinate system of X, Y, and Z as needed. In this case, an X direction (a first direction) coincides with a conveying direction (a sub-scanning direction) of a recording target medium P (e.g., paper). A Y direction (a thickness direction) coincides with a scanning direction (a main scanning direction) of the scanning mechanism 7. A Z direction (a second direction) represents a height direction (a gravitational direction) perpendicular to the X direction and the Y direction. In the following explanation, the description will be presented defining an arrow side as a positive (+) side, and an opposite side to the arrow as a negative (−) side in the drawings in each of the X direction, the Y direction, and the Z direction. In the present embodiment, a +Z side corresponds to an upward direction in the gravitational direction, and a −Z side corresponds to a downward direction in the gravitational direction.

The conveying mechanisms 2, 3 convey the recording target medium P toward a +X side. The conveying mechanisms 2, 3 each include a pair of rollers 11, 12 extending in, for example, the Y direction.

The ink tanks 4 respectively house ink of four colors such as yellow, magenta, cyan, and black. The inkjet heads 5 are configured so as to be able to respectively eject the four colors of ink, namely the yellow ink, the magenta ink, the cyan ink, and the black ink in accordance with the ink tanks 4 coupled thereto. It should be noted that the ink to be housed in the ink tanks 4 can be conductive ink, or can also be nonconductive ink.

Figure 2:
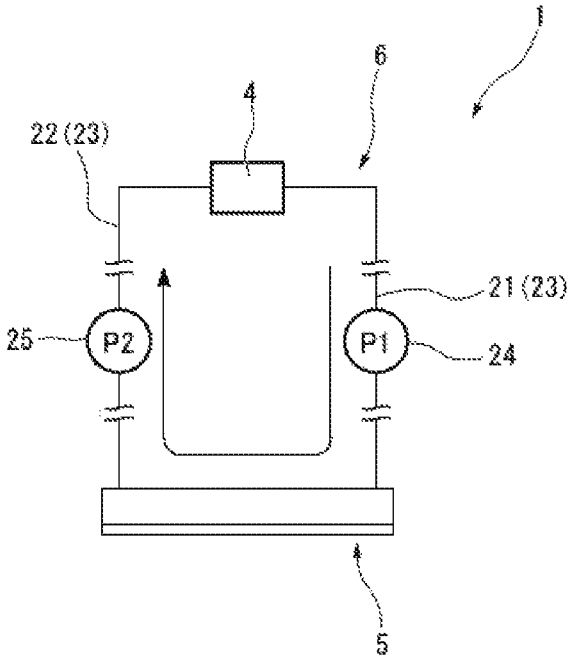
FIG. 2 is a schematic configuration diagram of an inkjet head and an ink circulation mechanism according to the embodiment.

FIG. 2 is a schematic configuration diagram of the inkjet head 5 and the ink circulation mechanism 6.

As shown in FIG. 1 and FIG. 2, the ink circulation mechanism 6 circulates the ink between the ink tank 4 and the inkjet head 5. Specifically, the ink circulation mechanism 6 is provided with a circulation flow channel 23 having an ink supply tube 21 and an ink discharge tube 22, a pressure pump 24 coupled to the ink supply tube 21, and a suction pump 25 coupled to the ink discharge tube 22.

The pressure pump 24 pressurizes the inside of the ink supply tube 21 to deliver the ink to the inkjet head 5 through the ink supply tube 21. Thus, the ink supply tube 21 is provided with positive pressure with respect to the ink jet head 5.

The suction pump 25 depressurizes the inside of the ink discharge tube 22 to suction the ink from the inkjet head 5 through the ink discharge tube 22. Thus, the ink discharge tube 22 is provided with negative pressure with respect to the ink jet head 5. It is arranged that the ink can circulate between the inkjet head 5 and the ink tank 4 through the circulation flow channel 23 by driving the pressure pump 24 and the suction pump 25.

The scanning mechanism 7 makes the inkjet heads 5 perform reciprocal scan in the Y direction. The scanning mechanism 7 is provided with a guide rail 28 extending in the Y direction, and a carriage 29 movably supported by the guide rail 28.

Inkjet Heads 5

As shown in FIG. 1, the inkjet heads 5 are mounted on the carriage 29. In the illustrated example, the plurality of inkjet heads 5 is mounted on the single carriage 29 so as to be arranged side by side in the Y direction. The inkjet heads 5 are each provided with a head chip 50 (see FIG. 3), an ink supply section (not shown) for coupling the ink circulation mechanism 6 and the head chip 50, and a control section (not shown) for applying a drive voltage to the head chip 50.

Head Chip 50

Figure 3:
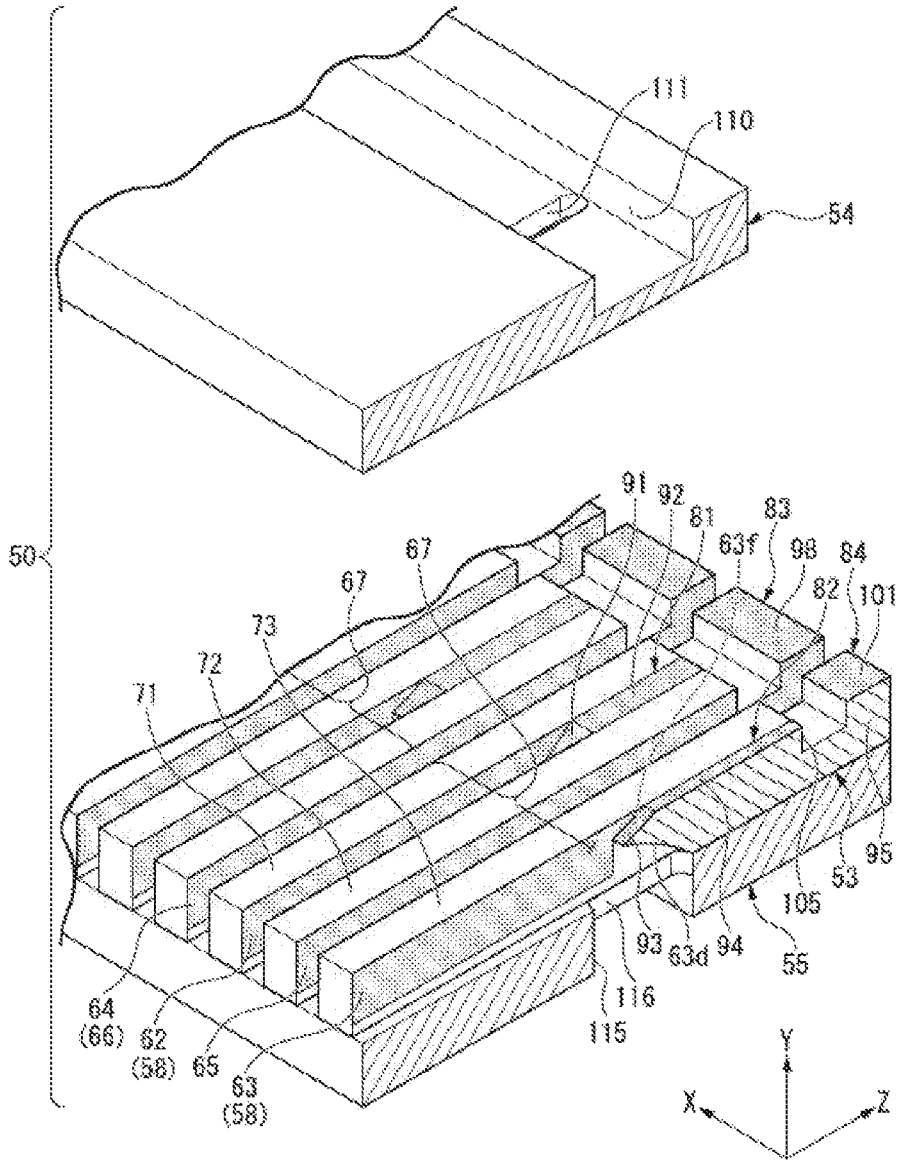
FIG. 3 is an exploded perspective view of a head chip according to the embodiment.
Figure 4:
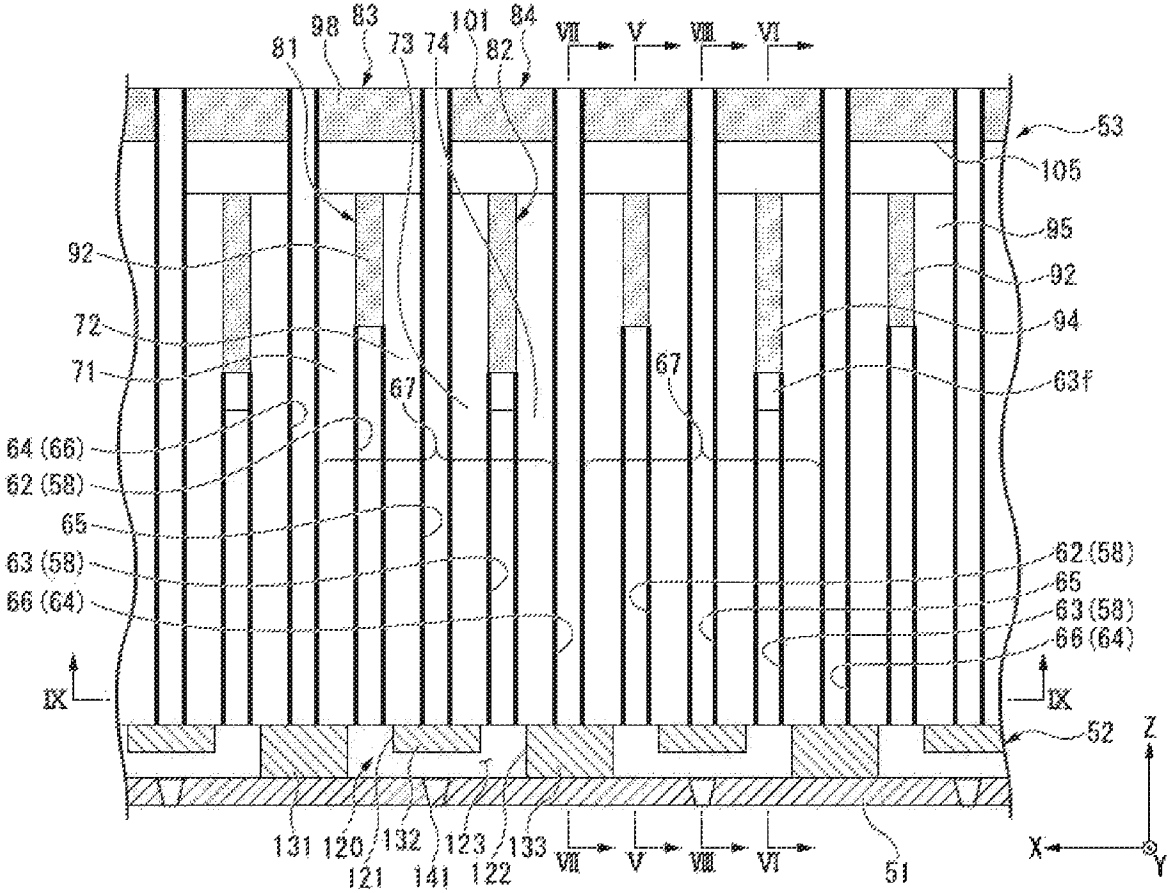
FIG. 4 is a cross-sectional view corresponding to the line IV-IV shown in FIG. 5.

FIG. 3 is an exploded perspective view of the head chip 50. FIG. 4 is a cross-sectional view corresponding to the line IV-IV shown in FIG. 5.

The head chip 50 shown in FIG. 3 and FIG. 4 is a so-called vertical circulating edge-shoot type head chip 50 which circulates the ink with the ink tank 4, and at the same time, ejects the ink from an end portion in the extending direction (the Z direction) in each of ejection channels 62, 63 described later. The head chip 50 is provided with a nozzle plate 51 (an end member; see FIG. 4), a feedback plate (an end member) 52, an actuator plate 53, and a first cover plate 54, and a second cover plate 55.

The actuator plate 53 is formed of a piezoelectric material such as PZT (lead zirconate titanate). The actuator plate 53 is a so-called monopole substrate in which a polarization direction, for example, is set unidirectional in the entire area in the Y direction (the thickness direction). It should be noted that the actuator plate 53 can be a so-called chevron substrate formed by, for example, stacking two piezoelectric plates different in polarization direction in the Y direction on one another.

The actuator plate 53 is provided with a plurality of circulation channels 58. The circulation channels 58 are disposed so as to be arranged side by side in the X direction in the actuator plate 53. The circulation channels 58 each include a first ejection channel (jet channel) 62, and a second ejection channel 63 disposed at the −X side with respect to the first ejection channel (the jet channel) 62.

In the actuator plate 53, in a portion located between the ejection channels 62, 63, there is formed one of non-ejection channels (non jet channels) 64 through 66 which are not filled with the ink. Out of the non-ejection channels 64 through 66, first non-ejection channels 64 are each disposed at the +X side of one of the circulation channels 58. Out of the non-ejection channels 64 through 66, second non-ejection channels 65 are each disposed between the first ejection channel 62 and the second ejection channel 63 in one of the circulation channels 58. Out of the non-ejection channels 64 through 66, third non-ejection channels 66 are each disposed at the −X side of one of the circulation channels 58. Therefore, the channels 62 through 66 are arranged in the X direction in the order of the first non-ejection channel 64, the first ejection channel 62, the second non-ejection channel 65, the second ejection channel 63, and the third non-ejection channel 66.

In the present embodiment, the first non-ejection channel 64 disposed at the +X side of one of the circulation channels 58 is commonly used as the third non-ejection channel 66 in another of the circulation channels 58 disposed at the +X side with respect to the one of the circulation channels 58. Further, the third non-ejection channel 66 disposed at the −X side of one of the circulation channels 58 is commonly used as the first non-ejection channel 64 in another of the circulation channels 58 disposed at the −X side with respect to the one of the circulation channels 58. It should be noted that it is possible for the first non-ejection channels 64 and the third non-ejection channels 66 to separately be provided in accordance with each of the circulation channels 58. Specifically, in a portion located between the circulation channels 58 adjacent to each other, there can be disposed the first non-ejection channel 64 corresponding to one of the circulation channels 58 and the third non-ejection channel 66 corresponding to the other of the circulation channels 58.

Each of the channels 62 through 66 extends in the Z direction in the actuator plate 53, and at the same time, penetrates the actuator plate 53 in the Y direction in at least a part thereof. It should be noted that the configuration in which the channel extension direction coincides with the Z direction will be described in the present embodiment, but the channel extension direction can cross the Z direction.

Each of the channels 62 through 66 will hereinafter be described in detail. In the following explanation, the description will be presented defining the +Y side as an obverse surface side, the −Y side as a reverse surface side, the +Z side as an upper side, and the −Z side as a lower side.

Figure 5:
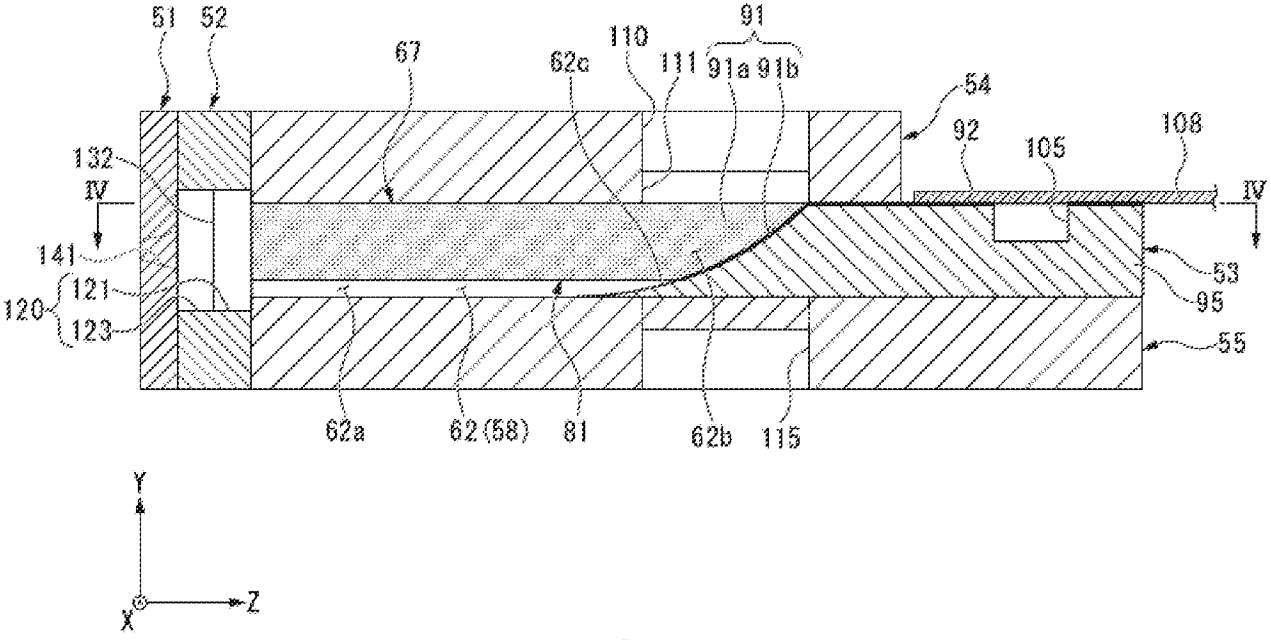
FIG. 5 is a cross-sectional view corresponding to the line V-V shown in FIG. 4.

FIG. 5 is a cross-sectional view corresponding to the line V-V shown in FIG. 4.

As shown in FIG. 5, the first ejection channels 62 are each a channel filled with the ink, and each constitute an upstream flow channel in a circulation process of the ink in the circulation channel 58. The first ejection channels 62 are formed by, for example, making a dicer 200 (see FIG. 10) having a disk-like shape enter the actuator plate 53 from the obverse surface side thereof.

The first ejection channels 62 are each provided with an extending part 62*a* and an uprise part 62*b*.

The extending part 62*a* penetrates the actuator plate 53 in the Y direction, and at the same time, extends in the Z direction. The extending part 62*a* is opened on a lower end surface (an end surface facing to one side in the second direction) of the actuator plate 53.

The uprise part 62*b* connects to an upper end of the extending part 62*a*. The uprise part 62*b* gradually shallows in depth in the Y direction along the upward direction. Specifically, a bottom surface (hereinafter referred to as a first guide surface 62*c*) of the uprise part 62*b* is formed as an inclined surface which extends while curving toward the obverse surface along the upward direction. It should be noted that the first guide surface 62*c* is only required to have a configuration in which the first guide surface 62*c* extends toward the obverse surface along the upward direction.

Figure 6:
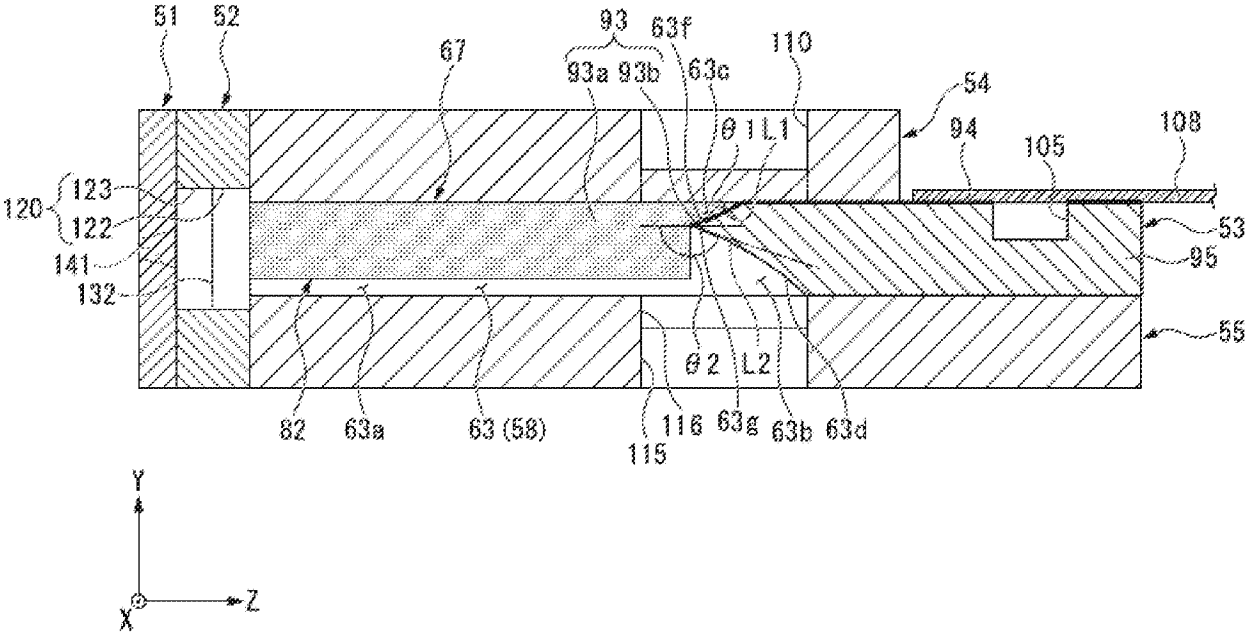
FIG. 6 is a cross-sectional view corresponding to the line VI-VI shown in FIG. 4.

FIG. 6 is a cross-sectional view corresponding to the line VI-VI shown in FIG. 4.

As shown in FIG. 6, the second ejection channel 63 faces the first ejection channel 62 across the second non-ejection channel 65 in the X direction. The second ejection channels 63 are each a channel filled with the ink, and each constitute a downstream flow channel in the circulation process of the ink in the circulation channel 58. A maximum dimension in the Z direction of the second ejection channel 63 is made equivalent to that of the first ejection channel 62. The second ejection channels 63 are formed by, for example, making the dicer 200 (see FIG. 10) having the disk-like shape enter the actuator plate 53 from the obverse surface side and the reverse surface side thereof.

The second ejection channels 63 are each provided with an extending part 63*a*, a reverse surface-side uprise part 63*b*, and an obverse surface-side uprise part 63*c*.

The extending part 63*a* penetrates the actuator plate 53 in the Y direction, and at the same time, extends in the Z direction. The extending part 63*a* is opened on the lower end surface of the actuator plate 53. An upper end of the extending part 63*a* is branched like a fork into the reverse surface-side uprise part 63*b* and the obverse surface-side uprise part 63*c*.

The reverse surface-side uprise part 63*b* is formed to have a circular arc shape convex toward the obverse surface in a side view viewed from the X direction. The reverse surface-side uprise part 63*b* gradually shallows in depth in the Y direction along the upward direction. Specifically, a bottom surface (hereinafter referred to as a second guide surface 63*d*) of the reverse surface-side uprise part 63*b* is formed as an inclined surface which extends while curving toward the reverse surface along the upward direction. In the Z direction, an upper end position of the reverse surface-side uprise part 63*b* is located at an equivalent level to an upper end position of the upside part 62*b*. It should be noted that the second guide surface 63*d* is only required to have a configuration in which the second guide surface 63*d* extends toward the reverse surface along the upward direction.

The obverse surface-side uprise part 63*c* is formed to have a circular arc shape convex toward the reverse surface in the side view. The obverse surface-side uprise part 63*c* gradually shallows in depth in the Y direction along the upward direction. Specifically, a bottom surface (hereinafter referred to as a film formation surface 630 of the obverse surface-side uprise part 63*c* is formed as an inclined surface which extends while curving toward the obverse surface along the upward direction. It should be noted that the film formation surface (an inclined surface) 63*f* is only required to have a configuration in which the film formation surface 63*f* extends toward the reverse surface along the upward direction. Further, in the illustrated example, the guide surfaces 62*c*, 63*d* and the film formation surface 63*f* can be the same as or different from each other in curvature radius.

In the present embodiment, it is preferable for the maximum depth of the reverse surface-side uprise part 63*b* to be made deeper compared to the maximum depth of the obverse surface-side uprise part 63*c*. Therefore, an upper end position of the obverse surface-side uprise part 63*c* is located below the upper end position of the reverse surface-side uprise part 63*b*. It should be noted that the maximum depth of the reverse surface-side uprise part 63*b* can be equivalent to the maximum depth of the obverse surface-side uprise part 63*c*, or can also be shallower than the obverse surface-side uprise part 63*c*.

The reverse surface-side uprise part 63*b* and the obverse surface-side uprise part 63*c* continue to each other via an edge part 63*g*. In other words, in the inner surface of the second ejection channel 63, the second guide surface 63*d* and the film formation surface 63*f* are exposed downward. In the present embodiment, the term "exposed," for example, downward is only required to include a Z direction component in a normal direction at an arbitrary position in the second guide surface 63*d* and the film formation surface 63*f* in the side view.

Here, in the side view, a first angle θ1 formed between the obverse surface of the actuator plate 53 and the film formation surface 63*f* is set smaller than a second angle θ2 formed between the obverse surface of the actuator plate 53 and the second guide surface 63*d*. In the present embodiment, the first angle θ1 means an angle formed between a first tangent line L1 passing an obverse surface-side opening edge of the second ejection channel 63 in the film formation surface 63*f* and the obverse surface of the actuator plate 53 in the cross-sectional view. In the present embodiment, the second angle θ2 means an angle formed between a second tangent line L2 passing an edge part 63*g* in the second guide surface 63*d* and the obverse surface of the actuator plate 53 in the cross-sectional view. In the present embodiment, the first angle θ1 forms an acute angle, and the second angle θ2 forms an obtuse angle. Further, in the illustrated example, the edge part 63*g* forms an acute angle. It should be noted that it is possible for the edge part 63*g* to form an obtuse angle.

Figure 7:
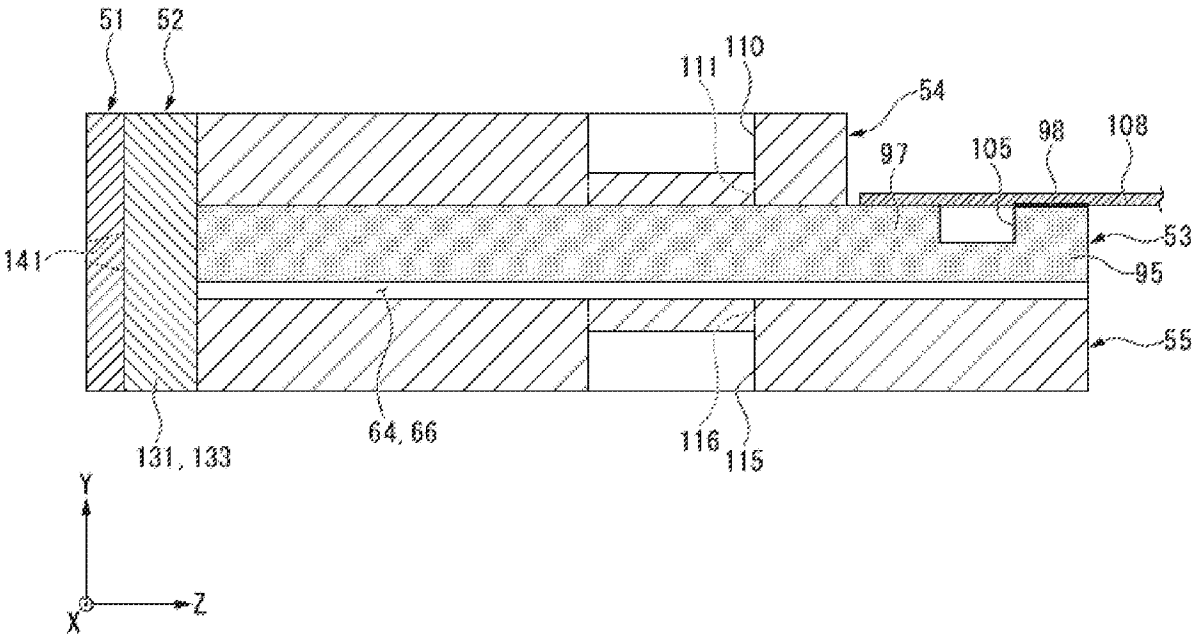
FIG. 7 is a cross-sectional view corresponding to the line VII-VII shown in FIG. 4.

FIG. 7 is a cross-sectional view corresponding to the line VII-VII shown in FIG. 4.

As shown in FIG. 7, the first non-ejection channel 64 is opposed to the first ejection channel 62 in the X direction. The first non-ejection channel 64 penetrates the actuator plate 53 in the Z direction and the Y direction.

Figure 8:
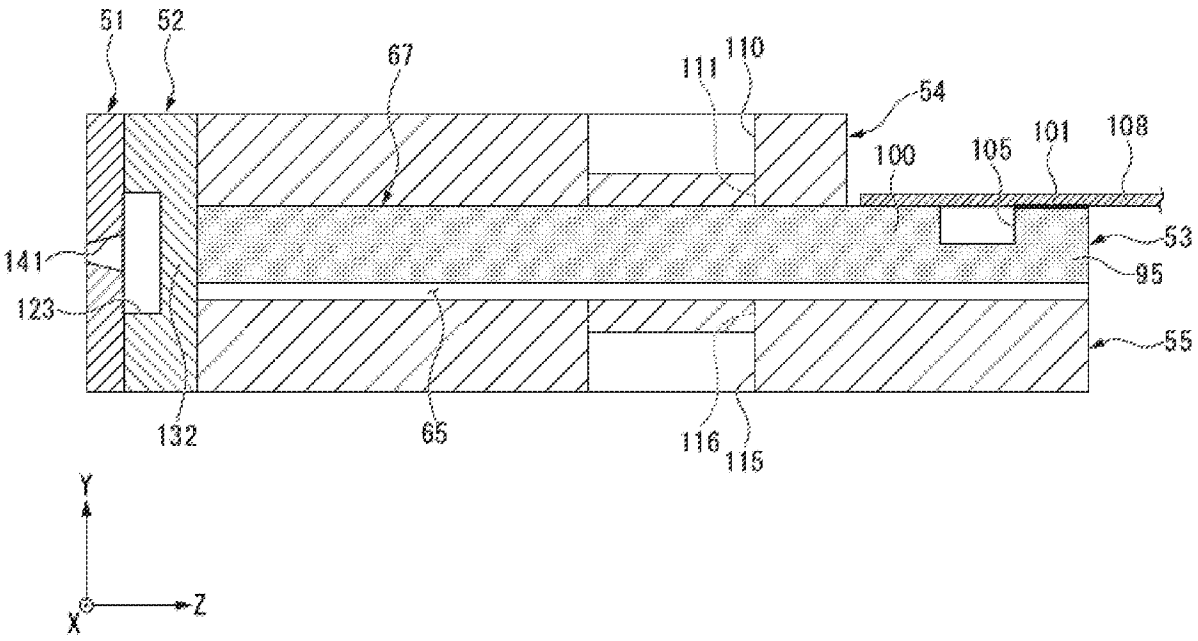
FIG. 8 is a cross-sectional view corresponding to the line VIII-VIII shown in FIG. 4.

FIG. 8 is a cross-sectional view corresponding to the line VIII-VIII shown in FIG. 4.

As shown in FIG. 8, the second non-ejection channel 65 is located between the first ejection channel 62 and the second ejection channel 63. The second non-ejection channel 65 penetrates the actuator plate 53 in the Z direction and the Y direction.

As shown in FIG. 7, the third non-ejection channel 66 is opposed to the second ejection channel 63 in the X direction. The third non-ejection channel 66 penetrates the actuator plate 53 in the Z direction and the Y direction. It should be noted that it is sufficient for each of the non-ejection channels 64 through 66 to penetrate the actuator plate 53 in the Z direction with respect to a portion opposed at least to the ejection channels 62, 63 in the X direction.

Figure 9:
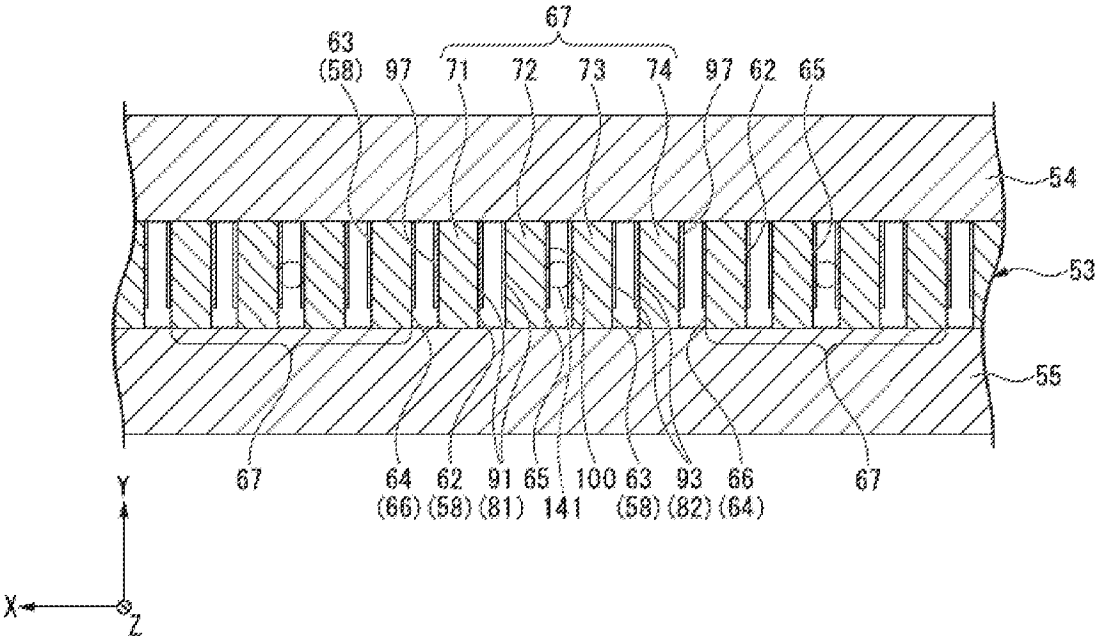
FIG. 9 is a cross-sectional view corresponding to the line IX-IX shown in FIG. 4.

FIG. 9 is a cross-sectional view corresponding to the line IX-IX shown in FIG. 4.

As shown in FIG. 4 and FIG. 9, in the actuator plate 53, a portion located between each of the first non-ejection channels 64 and corresponding one of the first ejection channels 62 constitutes a first upstream drive wall (a first drive wall) 71. In the actuator plate 53, a portion located between each of the first ejection channels 62 and corresponding one of the second non-ejection channels 65 constitutes a second upstream drive wall (a first drive wall) 72. In other words, the first ejection channels 62 are each surrounded by the first upstream drive wall 71 and the second upstream drive wall 72 at both sides in the X direction.

In the actuator plate 53, a portion located between each of the second non-ejection channels 65 and corresponding one of the second ejection channels 63 constitutes a first downstream drive wall (a second drive wall) 73. In the actuator plate 53, a portion located between each of the second ejection channels 63 and corresponding one of the third non-ejection channels 66 constitutes a second downstream drive wall (a second drive wall) 74. In other words, the second ejection channels 63 are each surrounded by the first downstream drive wall 73 and the second downstream drive wall 74 at both sides in the X direction.

In such a manner, the circulation channels 58 described above are each provided with a configuration in which the first ejection channel 62 is zoned by the upstream drive walls 71, 72, and the second ejection channel 63 is zoned by the downstream drive walls 73, 74. In the present embodiment, the first upstream drive wall 71 and the second upstream drive wall 72 corresponding to the first ejection channel 62, and the first downstream drive wall 73 and the second downstream drive wall 74 corresponding to the second ejection channel 63 constitute a drive cell 67 which ejects the ink circulating through one of the circulation channels 58 from one of nozzle holes 141. Therefore, the first upstream drive wall 71 in one of the drive cells 67 is opposed to the second downstream drive wall 74 in another of the drive cells 67 adjacent to the one of the drive cells 67 at the +X side across the first non-ejection channel 64. In contrast, the second downstream drive wall 74 in one of the drive cells 67 is opposed to the first upstream drive wall 71 in another of the drive cells 67 adjacent to the one of the drive cells 67 at the −X side across the third non-ejection channel 66.

As shown in FIG. 3 and FIG. 4, the actuator plate 53 is provided with first common interconnections (a first wiring section) 81, second common interconnections (a second wiring section) 82, first drive interconnections 83, and second drive interconnections 84.

The first common interconnections 81 are each provided with a first common electrode 91, and a first common terminal (a first terminal) 92.

As shown in FIG. 5, the first common electrode 91 is formed on an inner surface of the first ejection channel 62. The first common electrode 91 is provided with opposed electrodes 91*a* and a coupling part 91*b*. The opposed electrodes 91*a* are respectively formed on inner side surfaces (surfaces opposed to each other in the X direction out of the upstream drive walls 71, 72) of each of the first ejection channels 62. In the Y direction, the opposed electrodes 91*a* are each formed over a range no smaller than a half of the depth in the Y direction from the obverse surface side of the actuator plate 53 in corresponding one of the inner side surfaces of the first ejection channel 62. In the Z direction, the opposed electrodes 91*a* are each formed over the entire area of corresponding one of the inner side surfaces of the first ejection channel 62.

The coupling part 91*b* is formed on the first guide surface 62*c*. The coupling part 91*b* bridges between the opposed electrodes 91*a* inside the first ejection channel 62. It should be noted that the coupling part 91*b* is only required to be formed in a predetermined area connecting to at least the obverse surface-side opening edge of the first ejection channel 62 in the first guide surface 62*c*.

As shown in FIG. 4 and FIG. 5, the first common terminals 92 are each formed on an obverse surface of a portion (hereinafter referred to as a tail part 95) located at an upper side of the first ejection channel 62 in the actuator plate 53. The first common terminals 92 each extend linearly in the Z direction in a portion located within the width in the X direction of the first ejection channel 62 on the obverse surface of the tail part 95. The width in the X direction of the first common terminal 92 is made equivalent to the width of the first ejection channel 62.

A lower end edge of the first common terminal 92 is electrically coupled to the coupling part 91*b* formed on the first guide surface 62*c* at the obverse surface-side opening edge of the first ejection channel 62. In contrast, an upper end edge of the first common terminal 92 is terminated on the tail part 95.

As shown in FIG. 6, the second common interconnections 82 are each provided with a second common electrode 93 and a second common terminal (a second terminal) 94.

The second common electrode 93 is formed on an inner surface of the second ejection channel 63. The second common electrode 93 is provided with opposed electrodes 93*a* and a coupling part 93*b*. The opposed electrodes 93*a* are respectively formed on inner side surfaces (surfaces opposed to each other in the X direction out of the downstream drive walls 73, 74) of each of the second ejection channels 63. In the Y direction, the opposed electrodes 93*a* are each formed over a range no smaller than a half of the depth in the Y direction from the obverse surface side of the actuator plate 53 in corresponding one of the inner side surfaces of the second ejection channel 63. Specifically, the opposed electrodes 93*a* are each formed over the entire area of the obverse surface-side uprise part 63*c* in the Y direction, and at the same time, formed over the area no smaller than a half of the extending part 63*a*.

The coupling part 93*b* is formed over the entire area of the film formation surface 63*f*. The coupling part 93*b* bridges between the opposed electrodes 93*a* inside the second ejection channel 63. It should be noted that the coupling part 93*b* is only required to be formed in a predetermined area connecting to at least the obverse surface-side opening edge of the second ejection channel 63 in the film formation surface 63*f*.

As shown in FIG. 4 and FIG. 6, the second common terminals 94 each extend linearly in the Z direction in a portion located within the width in the X direction of the second ejection channel 63 on the obverse surface of the tail part 95. The width in the X direction of the second common terminal 94 is made equivalent to the width of the second ejection channel 63.

A lower end edge of the second common terminal 94 is electrically coupled to the coupling part 93*b* formed on the film formation surface 63*f* at the obverse surface-side opening edge of the second non-ejection channel 63. In contrast, an upper end edge of the second common terminal 94 is terminated on the tail part 95.

As shown in FIG. 4 and FIG. 7, the first drive interconnections 83 are each provided with first individual electrodes 97 and a first individual terminal 98.

The first individual electrodes 97 are respectively formed on an inner side surface facing the first non-ejection channel 64 out of the first upstream drive wall 71 and an inner side surface facing the second non-ejection channel 65 out of the second upstream drive wall 72. In the illustrated example, the first individual electrodes 97 are formed over a range no smaller than a half of the depth in the Y direction from the obverse surface side of the actuator plate 53 in the inner side surfaces of the respective non-ejection channels 64, 65.

The first individual terminal 98 is provided to a portion located at an upper side of the first common terminal 92 on the obverse surface of the tail part 95. The first individual terminal 98 is provided with a strip-like shape extending in the X direction. The first individual terminal 98 couples the first individual electrodes 97 opposed to each other in the X direction across the first ejection channel 62 at the opening edges of the non-ejection channels 64, 65 which are opposed to each other in the X direction across the first ejection channel 62.

As shown in FIG. 4 and FIG. 8, the second drive interconnections 84 are each provided with second individual electrodes 100 and a second individual terminal 101.

The second individual electrodes 100 are respectively formed on an inner side surface facing the second non-ejection channel 65 out of the first downstream drive wall 73 and an inner side surface facing the third non-ejection channel 66 out of the second downstream drive wall 74. In the illustrated example, the second individual electrodes 100 are formed over a range no smaller than a half of the depth in the Z direction from the obverse surface side of the actuator plate 53 in the inner side surfaces of the respective non-ejection channels 65, 66.

The second individual terminals 101 are each provided to a portion located at an upper side of the second common terminal 94 on the obverse surface of the tail part 95. The second individual terminal 101 is provided with a strip-like shape extending in the X direction. The second individual terminal 101 couples the second individual electrodes 100 opposed to each other in the X direction across the second ejection channel 63 at the opening edges of the non-ejection channels 65, 66 which are opposed to each other in the X direction across the second ejection channel 63.

In the tail part 95, a compartment groove 105 is formed in portions located between the first common terminals 92 and the first individual terminals 98 and portions located between the second common terminals 94 and the second individual terminals 101. The compartment groove 105 extends in the X direction in the tail part 95. The compartment groove 105 separates the first common terminals 92 and the first individual terminals 98 from each other, and separates the second common terminals 94 and the second individual terminals 101 from each other.

To the obverse surface of the tail part 95, there is pressure-bonded a flexible printed board 108. The flexible printed board 108 is coupled to the common terminals 92, 94 and the individual terminals 98, 101 on the obverse surface of the tail part 95. The flexible printed board 108 is pulled out upward.

First Cover Plate 54

As shown in FIG. 3, FIG. 5, and FIG. 6, the first cover plate 54 is fixed to the obverse surface of the actuator plate 53 with an adhesive or the like. Specifically, the first cover plate 54 is disposed with the thickness direction set to the Y direction. In the Z direction, a lower end surface of the first cover plate 54 is disposed coplanar with the lower end surface of the actuator plate 53. In the Z direction, an upper end surface of the first cover plate 54 is disposed at a lower side of the compartment groove 105 of the actuator plate 53. Therefore, the first cover plate 54 is fixed to the obverse surface of the actuator plate 53 in the state in which at least a part of the first common terminal 92 and the second common terminal 94 is exposed on the obverse surface of the tail part 95.

In the first cover plate 54, at a position overlapping the upper end portions of the circulation channels 58 viewed from the Y direction, there is formed an entrance common ink chamber 110. The entrance common ink chamber 110 extends in the X direction with a length sufficient for straddling, for example, the circulation channels 58, and at the same time, opens on the obverse surface of the first cover plate 54.

In the entrance common ink chamber 110, at positions overlapping the respective first ejection channels 62 viewed from the Y direction, there are formed entrance slits (a first liquid flow channel) 111. The entrance slits 111 each communicate the upper end portion of corresponding one of the first ejection channels 62 and the entrance common ink chamber 110 with each other. The entrance slits 111 are each opposed to the first guide surface 62*c* in the Y direction. Therefore, the entrance slits 111 are respectively communicated with the first ejection channels 62, and at the same time, are not communicated with the second ejection channels 63 and the non-ejection channels 64 through 66.

Second Cover Plate 55

The second cover plate 55 is fixed to the reverse surface of the actuator plate 53 with an adhesive or the like. Specifically, the second cover plate 55 is disposed with the thickness direction set to the Y direction. In the Z direction, a lower end surface of the second cover plate 55 is disposed coplanar with the lower end surface of the actuator plate 53. In the Z direction, an upper end surface of the second cover plate 55 is disposed coplanar with the upper end surface of the actuator plate 53.

In the second cover plate 55, at a position overlapping the upper end portions of the circulation channels 58 viewed from the Y direction, there is formed an exit common ink chamber 115. The exit common ink chamber 115 extends in the X direction with a length sufficient for straddling, for example, the circulation channels 58, and at the same time, opens on the reverse surface of the second cover plate 55

In the exit common ink chamber 115, at positions overlapping the respective second ejection channels 63 viewed from the Y direction, there are formed exit slits (a second liquid flow channel) 116. The exit slits 116 each communicate the upper end portion of corresponding one of the second ejection channels 63 and the exit common ink chamber 115 with each other. The exit slits 116 are each opposed to the second guide surface 63*d* in the Y direction. Therefore, the exit slits 116 are respectively communicated with the second ejection channels 63, and at the same time, are not communicated with the first ejection channels 62 and the non-ejection channels 64 through 66.

Feedback Plate 52

As shown in FIG. 4 through FIG. 6, the feedback plate 52 is fixed to the lower end surfaces of the actuator plate 53, the first cover plate 54, and the second cover plate 55 with an adhesive or the like in a lump. Specifically, the feedback plate 52 is disposed with the thickness direction set to the Z direction, and with the longitudinal direction set to the X direction.

To the feedback plate 52, there is provided a plurality of coupling channels 120. Each of the coupling channels 120 communicates the first ejection channel 62 and the second ejection channel 63 constituting each of the circulation channels 58 with each other. The coupling channels 120 are each formed to have a U-shape in a cross-sectional view perpendicular to the Y direction. Specifically, the coupling channels 120 are each provided with an outflow channel 121, an inflow channel 122, and a passage flow channel 123.

The outflow channel 121 is formed at a position overlapping a lower end opening part of the first ejection channel 62 in the plan view in the feedback plate 52. The outflow channel 121 opens on the upper surface of the feedback plate 52, and at the same time, extends in the Z direction.

The inflow channel 122 is formed at a position overlapping a lower end opening part of the second ejection channel 63 in the plan view in the feedback plate 52. The inflow channel 122 opens on the upper surface of the feedback plate 52, and at the same time, extends in the Z direction.

The passage flow channel 123 couples the lower end opening part of the outflow channel 121 and the lower end opening part of the inflow channel 122 to each other. Specifically, the passage flow channel 123 opens on the lower surface of the feedback plate 52, and at the same time, extends in the X direction. The passage flow channel 123 is communicated with the outflow channel 121 in the +X side end portion, and is communicated with the inflow channel 122 in the −X side end portion.

In the feedback plate 52, a portion located at the +X side with respect to one of the coupling channels 120 constitutes a first closure part 131 for covering (or closing) the lower end opening part of the first non-ejection channel 64 (the third non-ejection channel 66 corresponding to the drive cell 67 adjacent thereto at the +X side) corresponding to one of the drive cells 67 (the circulation channels 58).

In the feedback plate 52, a portion located between the outflow channel 121 and the inflow channel 122 of one of the coupling channel 120 constitutes a second closure part 132 for covering the lower end opening part of the second non-ejection channel 65 corresponding to one of the drive cells 67 (the circulation channels 58).

In the feedback plate 52, a portion located at the −X side with respect to one of the coupling channels 120 constitutes a third closure part 133 for covering the lower end opening part of the third non-ejection channel 66 (the first non-ejection channel 64 corresponding to the other drive cell 67 adjacent thereto at the −X side) corresponding to one of the drive cells 67 (the circulation channels 58).

Therefore, the feedback plate 52 covers the non-ejection channels 64 through 66 while communicating the ejection channels 62, 63 constituting one of the drive cells 67 (the circulation channels 58) with each other.

It should be noted that the feedback plate 52 is described as a single layer member in the present embodiment, but is not limited to this configuration. It is possible for the feedback plate 52 to have a laminate structure or the like with, for example, a first plate provided with the outflow channel 121 and the inflow channel 122, and a second plate provided with the passage flow channel 123.

As shown in FIG. 4, the nozzle plate 51 is fixed to the lower surface of the feedback plate 52 with an adhesive or the like. The nozzle plate 51 is disposed with the thickness direction set to the Z direction, and with the longitudinal direction set to the X direction. In the present embodiment, the nozzle plate 51 is formed of a resin material such as polyimide so as to have a thickness of about 50 μm. It should be noted that it is possible for the nozzle plate 51 to have a single layer structure or a laminate structure with a metal material (SUS, Ni—Pd, or the like), glass, silicone, or the like besides the resin material.

The nozzle plate 51 is provided with a plurality of nozzle holes 141 penetrating the nozzle plate 51 in the Z direction. The nozzle holes 141 are each formed at a position overlapping corresponding one of the passage flow channels 123 in the plan view in the nozzle plate 51. Therefore, the coupling channels 120 are communicated with the outside of the head chip 50 through the nozzle holes 141, respectively. Each of the nozzle holes 141 is formed to have, for example, a taper shape having the inner diameter gradually decreasing along a direction from the upper side toward the lower side. In the illustrated example, an upper end opening part of the nozzle hole 141 opens in a central portion (at a position overlapping the second closure part 132 in the plan view) in the X direction in the passage flow channel 123. It should be noted that the nozzle hole 141 can be disposed at, for example, an arbitrary position in the X direction providing there is adopted a configuration in which the nozzle hole 141 is communicated with the passage flow channel 123.

Operation Method of Printer 1

Then, there will hereinafter be described when recording a character, a figure, or the like on the recording target medium P using the printer 1 configured as described above.

It should be noted that it is assumed that as an initial state, the sufficient ink having colors different from each other is respectively encapsulated in the four ink tanks 4 shown in FIG. 1. Further, there is provided the state in which the inkjet heads 5 are filled with the ink in the ink tanks 4 via the ink circulation mechanisms 6, respectively.

Under such an initial state, when making the printer 1 operate, the recording target medium P is conveyed toward the +X side while being pinched by the rollers 11, 12 of the conveying mechanisms 2, 3. Further, by the carriage 29 moving in the Y direction at the same time, the inkjet heads 5 mounted on the carriage 29 reciprocate in the Y direction.

While the inkjet heads 5 reciprocate, the ink is arbitrarily ejected toward the recording target medium P from each of the inkjet heads 5. Thus, it is possible to perform recording of the character, the image, and the like on the recording target medium P.

Here, the operation of each of the inkjet heads 5 will hereinafter be described in detail.

In such a vertically circulating edge-shoot type inkjet head 5 as in the present embodiment, first, by making the pressure pump 24 and the suction pump 25 shown in FIG. 2 operate, the ink is circulated in the circulation flow channel 23. In this case, the ink circulating through the ink supply tube 21 is supplied into the first ejection channel 62 of each of the circulation channels 58 through the entrance common ink chamber 110 and the entrance slits 111. The ink supplied to the inside of the first ejection channel 62 is circulated downward inside the first ejection channel 62 while being guided by the first guide surface 62*c*. Subsequently, the ink outflows into the coupling channel 120 (the outflow channel 121) through the lower end opening part of the first ejection channel 62. The ink flowing through the coupling channel 120 inflows into the second ejection channel 63 via the passage flow channel 123 and the inflow channel 122 through the lower end opening part of the second ejection channel 63. The ink having flowed into the second ejection channel 63 is circulated upward inside the second ejection channel 63, and then flows toward the exit slit 116 while being guided by the second guide surface 63*d*. Then, the ink is discharged to the exit common ink chamber 115 through the exit slits 116, and is then returned to the ink tank 4 through the ink discharge tube 22. Thus, it is possible to circulate the ink between the inkjet head 5 and the ink tank 4.

When the reciprocation of the inkjet head 5 is started due to the translation of the carriage 29 (see FIG. 1), the drive voltages are applied between the first common electrodes 91 and the first individual electrodes 97, and between the second common electrodes 93 and the second individual electrodes 100, respectively, via the flexible printed board 108. On this occasion, the individual electrodes 97, 100 are set at a drive potential Vdd, and the common electrodes 91, 93 are set at a reference potential GND to apply the drive voltages between the electrodes, respectively. Then, a thickness-shear deformation occurs in each of the upstream walls 71, 72 partitioning the first ejection channel 62, and the downstream drive walls 73, 74 partitioning the second ejection channel 63. Thus, each of the drive walls 71 through 74 flexurally deforms to form a V shape centering on an intermediate portion in the Y direction. In other words, the upstream drive walls 71, 72 deform so as to increase the volume of the first ejection channel 62, and the downstream drive walls 73, 74 deform so as to increase the volume of the second ejection channel 63.

After increasing the volume of each of the ejection channels 62, 63, the voltage applied between the first common electrode 91 and the first individual electrode 97, and the voltage applied between the second common electrode 93 and the second individual electrode 100 are set to zero. Then, the drive walls 71 through 74 are restored, and the volume of each of the ejection channels 62, 63 having once increased is restored to the original volume. Thus, the internal pressure of the ejection channels 62, 63 increases to pressure the ink. Then, pressure waves generated due to the increase in pressure in the respective ejection channels 62, 63 propagate to the coupling channel 120. As a result, the ink in the passage flow channel 123 is ejected as a droplet through the nozzle hole 141. By the ink ejected from the nozzle hole 141 landing on the recording target medium P, it is possible to record the character, the image, and the like on the recording target medium P.

Method of Manufacturing Head Chip 50

Then, a method of manufacturing such a head chip 50 as described above will be described. FIG. 10 through FIG. 15 are each a diagram for explaining a step of the method of manufacturing the head chip 50, and are each a perspective view corresponding to FIG. 3. In the following description, when manufacturing the head chip 50 in a scale of chips will be described as an example for the sake of convenience.

The method of manufacturing the head chip 50 is provided with a reverse surface processing step, a second cover plate stacking step, a grinding step, a pattern formation step, an obverse surface processing step, a film formation step, and a first cover plate stacking step. It should be noted that it is assumed that the processing necessary in advance of the stacking step has already been performed on each of the plates 53 through 55.

Figure 10:
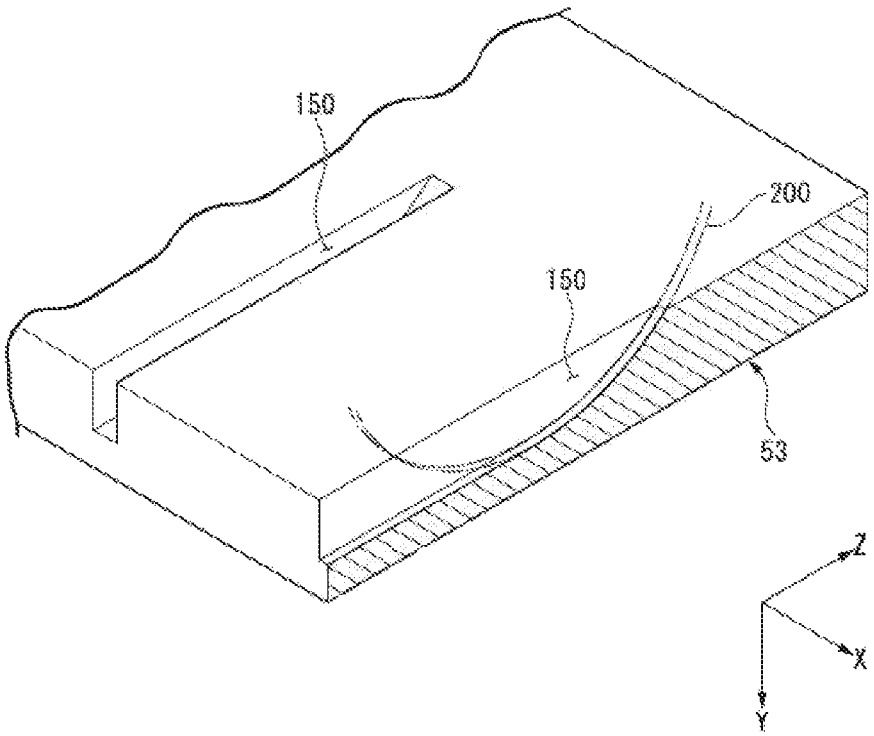
FIG. 10 is a diagram for explaining a step of a method of manufacturing the head chip according to the embodiment, and is a perspective view corresponding to FIG. 3.

As shown in FIG. 10, in the reverse surface processing step, a reverse surface-side recessed part 150 is provided to the actuator plate 53. The reverse surface-side recessed part 150 constitutes the reverse surface-side uprise part 63*b* and a part (a reverse surface side) of the extending part 63*a* in the second ejection channel 63 shown in FIG. 6. In the reverse surface processing step, the dicer 200 having a disk-like shape is made to enter a processing area of the second ejection channel 63 in the actuator plate 53 from the reverse surface side of the actuator plate 53. On this occasion, an amount of penetration of the dicer is set shallower than the thickness of the actuator plate 53. Due to the reverse surface processing step, the reverse surface-side recessed part 150 having an arc-like shape convex toward the obverse surface is provided to the actuator plate 53.

Figure 11:
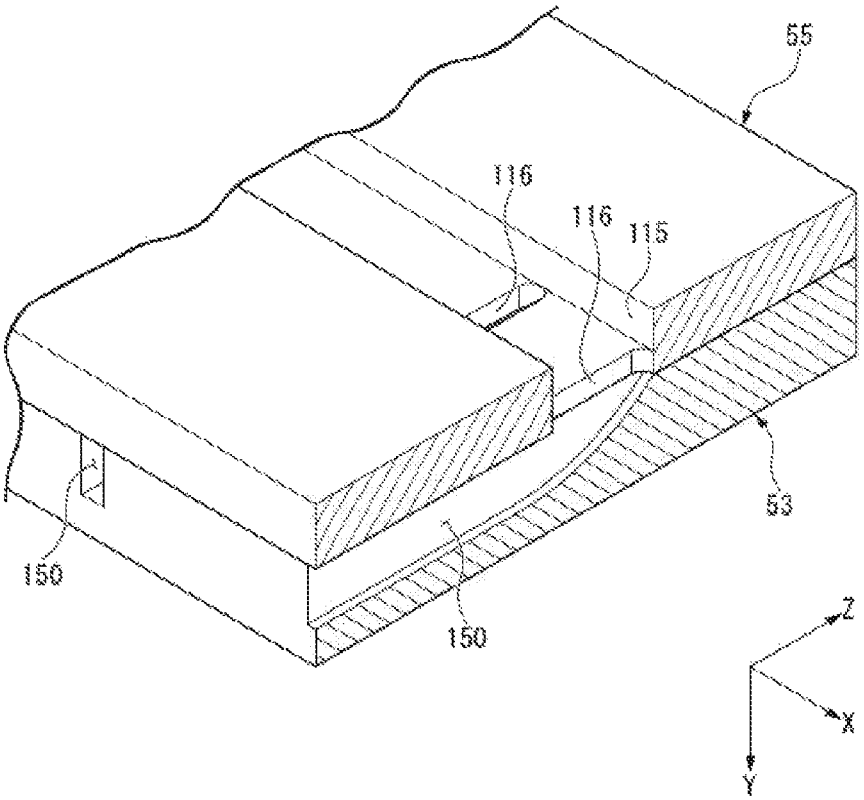
FIG. 11 is a diagram for explaining a step of the method of manufacturing the head chip according to the embodiment, and is a perspective view corresponding to FIG. 3.

As shown in FIG. 11, in the second cover plate stacking step, the second cover plate 55 is stacked on the reverse surface of the actuator plate 53. Specifically, the actuator plate 53 and the second cover plate 55 are bonded to each other so that each of the exit slits 116 is communicated with corresponding one of the reverse surface-side recessed parts 150.

Figure 12:
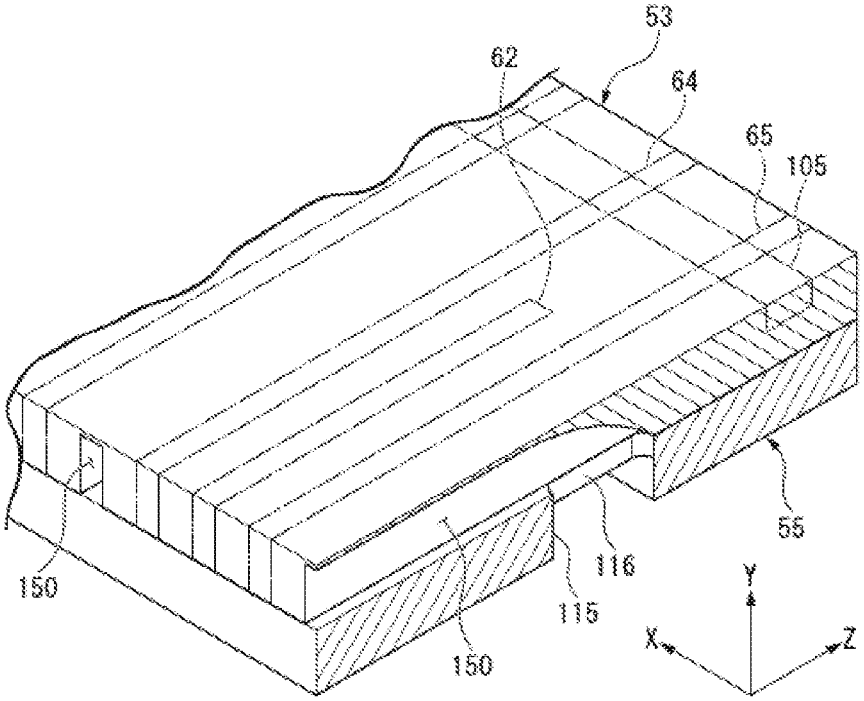
FIG. 12 is a diagram for explaining a step of the method of manufacturing the head chip according to the embodiment, and is a perspective view corresponding to FIG. 3.

As shown in FIG. 12, in the grinding step, grinding processing is performed on the obverse surface of the actuator plate 53. On this occasion, a processing amount of the grinding processing is preferably set to the extent that the reverse surface-side recessed part 150 does not open on the obverse surface of the actuator plate 53.

Figure 13:
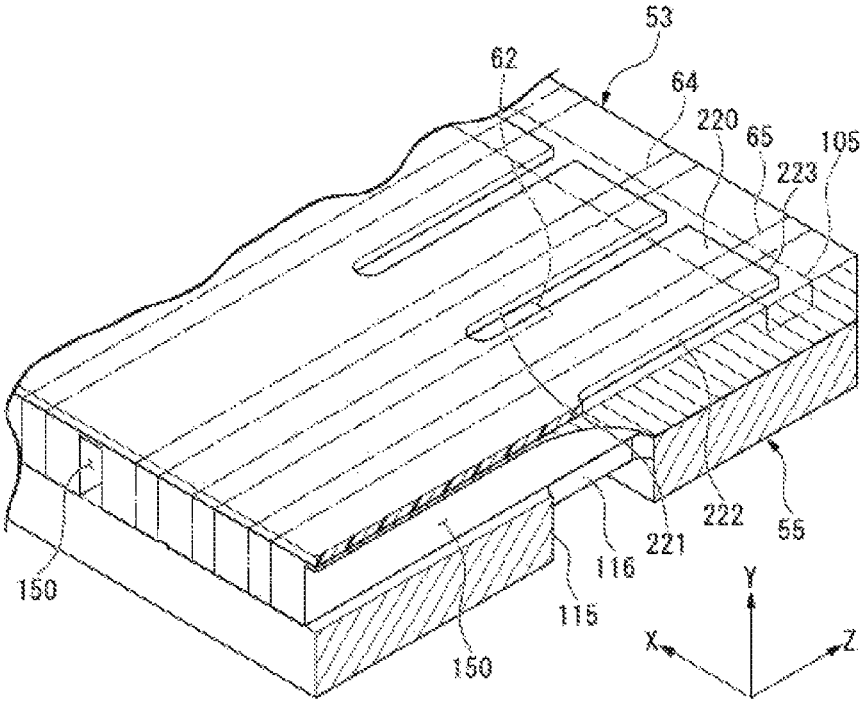
FIG. 13 is a diagram for explaining a step of the method of manufacturing the head chip according to the embodiment, and is a perspective view corresponding to FIG. 3.

As shown in FIG. 13, in the mask formation step, a mask pattern 220 is formed on the obverse surface of the actuator plate 53. Specifically, a mask material (e.g., a resist film) is formed on the obverse surface of the actuator plate 53, and then patterning is performed on the mask material using a photolithography technology. On this occasion, there is formed the mask pattern 220 in which at least processing areas of the common terminals 92, 94 and the individual terminals 98, 101 open in the mask material. In the illustrated example, a mask openings 221 for the first common terminals 92 and the mask openings 222 for the second common terminals 94 provided to the mask pattern 220 each extend in the Z direction on the obverse surface of the tail part 95. A lower end portion of the mask opening 221 overlaps a part of the processing area of the first ejection channel 62 when viewed from the Y direction. A lower end portion of the mask opening 222 overlaps a part of the processing area of the second ejection channel 63 when viewed from the Y direction. It should be noted that it is sufficient for the mask openings 221, 222 to reach the corresponding processing area of ejection channels 62, 63 in at least the lower end portions thereof.

In contrast, an upper end portion of each of the mask openings 221, 222 overlaps a processing area (see the dashed-two-dotted line 105 in FIG. 13) of the compartment groove 105 when viewed from the Y direction.

The mask opening 223 for the individual terminals 98, 101 provided to the mask pattern 220 extends in the X direction on the obverse surface of the tail part 95. A part of the mask opening 223 overlaps the processing area of the compartment groove 105 in the plan view. It should be noted that the mask opening 223 is not required to reach the processing area of the compartment groove 105.

Figure 14:
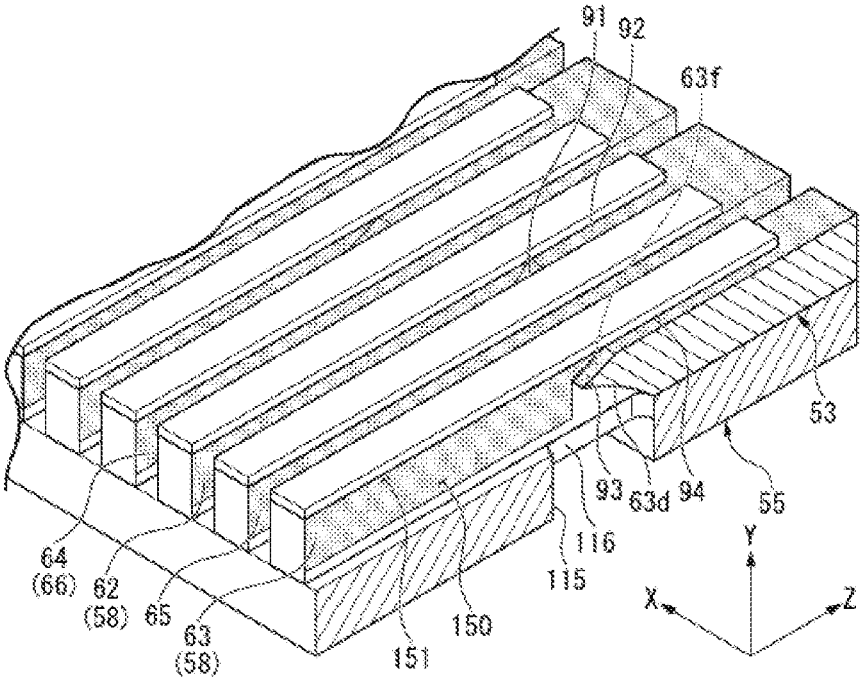
FIG. 14 is a diagram for explaining a step of the method of manufacturing the head chip according to the embodiment, and is a perspective view corresponding to FIG. 3.

In the obverse surface processing step shown in FIG. 14, the first ejection channels 62, the obverse surface-side recessed parts 151, and the non-ejection channels 64 through 66 are provided to the actuator plate 53. The obverse surface-side recessed parts 151 each constitute the obverse surface-side uprise part 63*c* and a part (an obverse surface side) of the extending part 63*a* in each of the second ejection channels 63. In the obverse surface processing step, in order to process the first ejection channels 62, the dicer 200 having a disk-like shape is made to enter processing areas of the first ejection channels 62 in the actuator plate 53 from the obverse surface side of the actuator plate 53. On this occasion, an amount of penetration of the dicer 200 is set slightly deeper than the thickness of the actuator plate 53. Thus, the first ejection channels 62 penetrate the actuator plate 53 in the Y direction.

In the obverse surface processing step, in order to process the obverse surface-side recessed parts 151, the dicer 200 having a disk-like shape is made to enter processing areas of the second ejection channels 63 in the actuator plate 53 from the obverse surface side of the actuator plate 53. On this occasion, an amount of penetration of the dicer 200 is set deeper than the shortest distance between the reverse surface-side recessed part 150 and the obverse surface of the actuator plate 53, and shallower than the amount of penetration of the dicer 200 in the reverse surface processing step described above. When making the dicer 200 enter the actuator plate 53, the actuator plate 53 is cut together with a portions of the mask pattern 220 covering the processing areas of the second ejection channels 63. Thus, the obverse surface-side recessed parts 151 each having an arc-like shape convex toward the reverse surface are provided to the actuator plate 53. Further, the obverse surface-side recessed part 151 and the reverse surface-side recessed part 150 are communicated with each other to form the second ejection channel 63. On this occasion, in the obverse surface-side recessed part 151, the film formation surface 63*f* provided to the obverse surface-side uprise part 63*c* is exposed at the obverse surface side through the obverse surface-side opening part of the second ejection channel 63.

In the obverse surface processing step, in order to form the non-ejection channels 64 through 66, the processing is achieved by making the dicer 200 having a disk-like shape enter processing areas of the non-ejection channels 64 through 66 in the actuator plate 53 from the obverse surface side of the actuator plate 53. On this occasion, an amount of penetration of the dicer 200 is set slightly deeper than the thickness of the actuator plate 53. Thus, the non-ejection channels 64 through 66 penetrate the actuator plate 53 in the Y direction.

In the film formation step, an electrode material is deposited from the obverse surface side of the actuator plate 53 to thereby form the interconnections 81 through 84. In the present embodiment, in the film formation step, the electrode material is deposited from a direction tilted toward the X direction with respect to the obverse surface of the actuator plate 53 using, for example, oblique evaporation. Then, the electrode material is deposited on the obverse surface of the actuator plate 53 through the mask openings 221 through 223 of the mask pattern 220, and at the same time, the electrode material is deposited on the inner surfaces of the channels 62 through 66 through the obverse surface-side opening parts of the respective channels 62 through 66. After the deposition of the electrode material, the mask pattern 220 is removed using a liftoff process or the like to terminate the film formation step.

Figure 15:
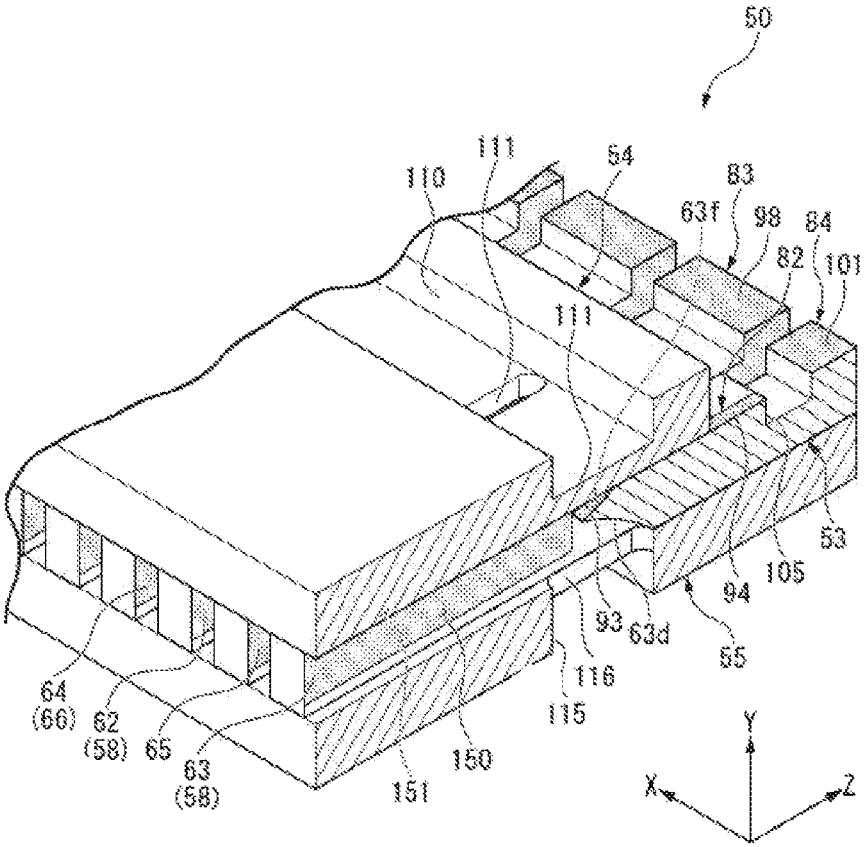
FIG. 15 is a diagram for explaining a step of the method of manufacturing the head chip according to the embodiment, and is a perspective view corresponding to FIG. 3.

As shown in FIG. 15, in the first cover plate stacking step, the first cover plate 54 is stacked on the obverse surface of the actuator plate 53. Specifically, the actuator plate 53 and the first cover plate 54 are bonded to each other so that each of the entrance slits 111 is communicated with corresponding one of the obverse surface-side recessed parts 151. Thus, an assembly 230 of the actuator plate 53 and the covers 54, 55 is formed.

Subsequently, the feedback plate 52 is bonded to a lower end surface of the assembly 230. On this occasion, the feedback plate 52 is bonded to the assembly 230 so that the coupling channels 120 are each communicated with the first ejection channel 62 and the second ejection channel 63 constituting corresponding one of the circulation channels 58.

Subsequently, the nozzle plate 51 is bonded to the lower end surface of the feedback plate 52. On this occasion, the nozzle plate 51 is bonded to the feedback plate 52 so that the nozzle holes 141 are communicated with the corresponding coupling channels 120.

Due to the steps described hereinabove, the head chip 50 is manufactured.

It should be noted that the head chip 50 can be manufactured in terms of wafer. When manufacturing the head chips 50 in terms of wafer, an actuator wafer having a plurality of actuator plates 53 connected to each other, a first cover wafer having a plurality of first cover plates 54 connected to each other, and a cover wafer having a plurality of second cover plates 55 connected to each other are bonded to one another to form a wafer assembly. Subsequently, the wafer assembly is cut, and then the feedback plates 52 and the nozzle plates 51 described above are attached to the wafer assembly to thereby form the plurality of head chips 50.

As described above, in the head chip 50 according to the present embodiment, there is adopted the configuration in which out of the ejection channels 62, 63 located at both sides in the circulation direction of the ink across the coupling channel 120, the first ejection channel 62 is surrounded by the pair of upstream drive walls 71, 72, and the second ejection channel 63 is surrounded by the pair of downstream drive walls 73, 74.

According to this configuration, when performing the ejection, by deforming each of the upstream drive walls 71, 72 and the downstream drive walls 73, 74, it is possible to increase the volume variation in the ink channels (the channel from the first ejection channel 62 to the second ejection channel 63 via the coupling channel 120). As a result, it is possible to generate a high pressure wave to the ink in the ink channel. Therefore, it is possible to ensure the sufficient ejection pressure of the ink.

In the present embodiment, there is adopted the configuration in which the first upstream drive wall 71 out of the pair of upstream drive walls 71, 72 is the portion located between the first ejection channel 62 and the first non-ejection channel 64, and the second upstream drive wall 72 is the portion located between the first ejection channel 62 and the second non-ejection channel 65. Further, there is adopted the configuration in which the first downstream drive wall 73 out of the pair of downstream drive walls 73, 74 is the portion located between the second ejection channel 63 and the second non-ejection channel 65, and the second downstream drive wall 74 is the portion located between the second ejection channel 63 and the third non-ejection channel 66.

According to this configuration, by forming the non-ejection channels 64 through 66 between the ejection channels 62, 63, the drive walls 71 through 74 are formed in the portions surrounded by the ejection channels 62, 63 and the non-ejection channels 64 through 66. Thus, it is possible to easily form the drive walls 71 through 74 at both sides of the ejection channels 62, 63.

In the present embodiment, there is adopted the configuration in which the feedback plate 52 is provided with the closure parts 131 through 133 for covering the lower end opening parts of the non-ejection channels 64 through 66.

According to this configuration, by covering the lower end opening parts of the non-ejection channels 64 through 66 with the feedback plate 52, it is possible to extend the drive walls 71 through 74 up to the lower end surface of the actuator plate 53. Thus, it is easy to effectively propagate the ejection pressure of the ink to the nozzle holes.

In the present embodiment, there is adopted the configuration in which the first cover plate 54 provided with the entrance slits 111 communicated with the respective first ejection channels 62 is disposed at the obverse surface side of the actuator plate 53, and the second cover plate 55 provided with the exit slits 116 communicated with the respective second ejection channels 63 is disposed at the reverse surface side of the actuator plate 53.

According to this configuration, by the first ejection channels 62 and the second ejection channels 63 opening at least on the surfaces different from each other of the actuator plate 53, it becomes possible to dispose the entrance side and exit side cover plates 54, 55 respectively at the both sides in the thickness direction with respect to the actuator plate 53. Thus, it is possible to achieve the simplification of the configuration compared to when providing the entrance slits and the exit slits to a single cover plate.

In the present embodiment, there is adopted the configuration in which the first common interconnections 81 formed over the inner surface of the first ejection channel 62 and the obverse surface of the tail part 95, and the second common interconnections 82 formed over the inner surface of the second ejection channel 63 and the obverse surface of the tail part 95 are provided to the actuator plate 53.

According to this configuration, it is possible to couple the common interconnections 81, 82 corresponding to the respective ejection channels 62, 63 to the flexible printed board 108 at the obverse surface side of the actuator plate 53. Thus, it is possible to achieve the simplification of the configuration.

In the present embodiment, there is adopted the configuration in which the first ejection channel 62 is provided with the first guide surface 62*c* extending downward along the direction toward the reverse surface, and the second ejection channel 63 is provided with the second guide surface 63*d* extending downward along the direction toward the obverse surface.

According to this configuration, the ink having flowed into the first ejection channel 62 from the entrance slit 111 smoothly flows toward the coupling channel 120 along the first guide surface 62*c*. Meanwhile, the ink having flowed into the second ejection channel 63 from the coupling channel 120 smoothly flows toward the exit slit 116 along the second guide surface 63*d*. Thus, it is possible to reduce the pressure loss in the ejection channels 62, 63 to efficiently circulate the ink in the ink channel.

The film formation surface 63*f* which constitutes a part of the obverse surface-side opening edge of the second ejection channel 63, and extends downward along the direction toward the reverse surface is provided to the surface exposed downward in the inner surface of the second ejection channel 63 in the head chip 50 according to the present embodiment. In the head chip 50 according to the present embodiment, there is adopted the configuration in which the first angle θ1 formed between the obverse surface of the actuator plate 53 and the film formation surface 63*f* is set smaller than the second angle θ2 formed between the obverse surface of the actuator plate 53 and the second guide surface 63*d*.

According to this configuration, the film formation surface 63*f* is exposed to the outside through the obverse surface-side opening part of the second ejection channel 63. Therefore, when introducing the electrode material of the second common electrode 93 into the second ejection channel 63 through the obverse surface-side opening part of the second ejection channel 63, it is possible to efficiently deposit the electrode material of the second common electrode 93 on the film formation surface 63*f*. Further, by coupling the second common electrode 93 and the second common terminal 94 to each other in the coupling part 93*b*, it is possible to ensure the electrical coupling between the second common electrode 93 and the second common terminal 94 via the obverse surface-side opening edge of the second ejection channel 63.

Modified Example

Figure 16:
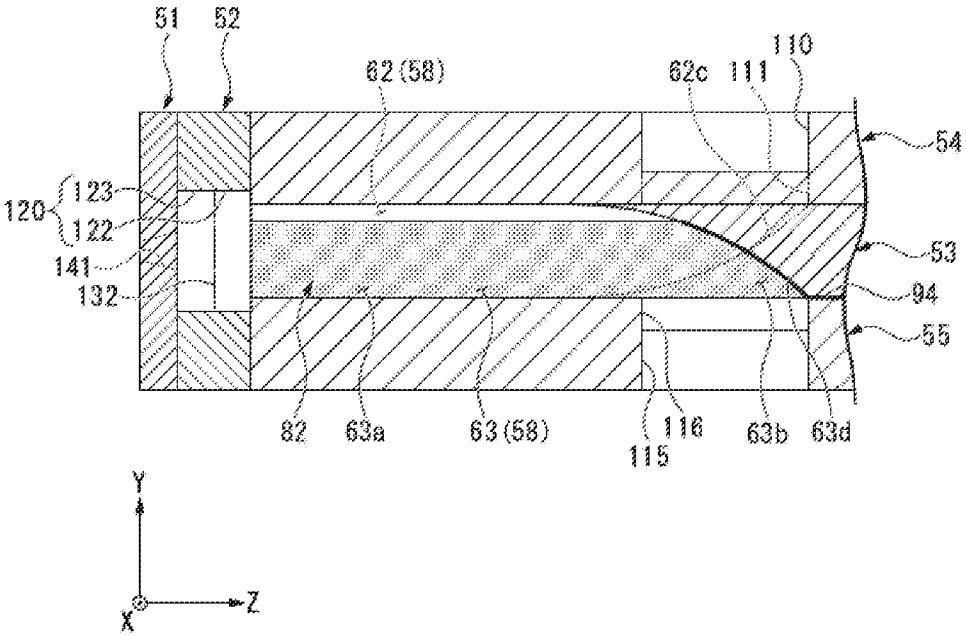
FIG. 16 is a cross-sectional view corresponding to FIG. 6 related to a modified example of the embodiment.

Then, a modified example of the embodiment described above will be described. In the embodiment described above, there is described the configuration in which the second ejection channel 63 is provided with the film formation surface 63*f*, but this configuration is not a limitation. For example, it is possible to adopt a configuration in which the second ejection channel 63 has only the second guide surface 63*d* extending toward the opposite side to the first guide surface 62*c* of the first ejection channel 62 as in the head chip 50 shown in FIG. 16. Specifically, in the actuator plate 53 in the present modified example, the first guide surface 62*c* extends toward the obverse surface along the upward direction on the one hand, and the second guide surface 63*d* extends toward the reverse surface along the upward direction. In this case, the second common terminal 94 is laid around on the reverse surface of the tail part 95 via the second guide surface 63*d*. The second common terminal 94 can be realized by separately pressure-bonding the flexible printed board at the reverse surface side of the tail part 95, or can be laid around on the obverse surface of the tail part 95 through the upper end surface of the tail part 95 or a through hole or the like of the tail part 95.

Also in the present modified example, the first guide surface 62*c* is opposed to the entrance slit 111 in the Y direction, the second guide surface 63*d* is opposed to the exit slit 116 in the Y direction.

Therefore, the ink having flowed into the first ejection channel 62 from the entrance slit 111 smoothly flows toward the coupling channel 120 along the first guide surface 62*c*. Meanwhile, the ink having flowed into the second ejection channel 63 from the coupling channel 120 smoothly flows toward the exit slit 116 along the second guide surface 63*d*. Thus, it is possible to reduce the pressure loss in the ejection channels 62, 63 to efficiently circulate the ink in the ink channel.

Figure 17:
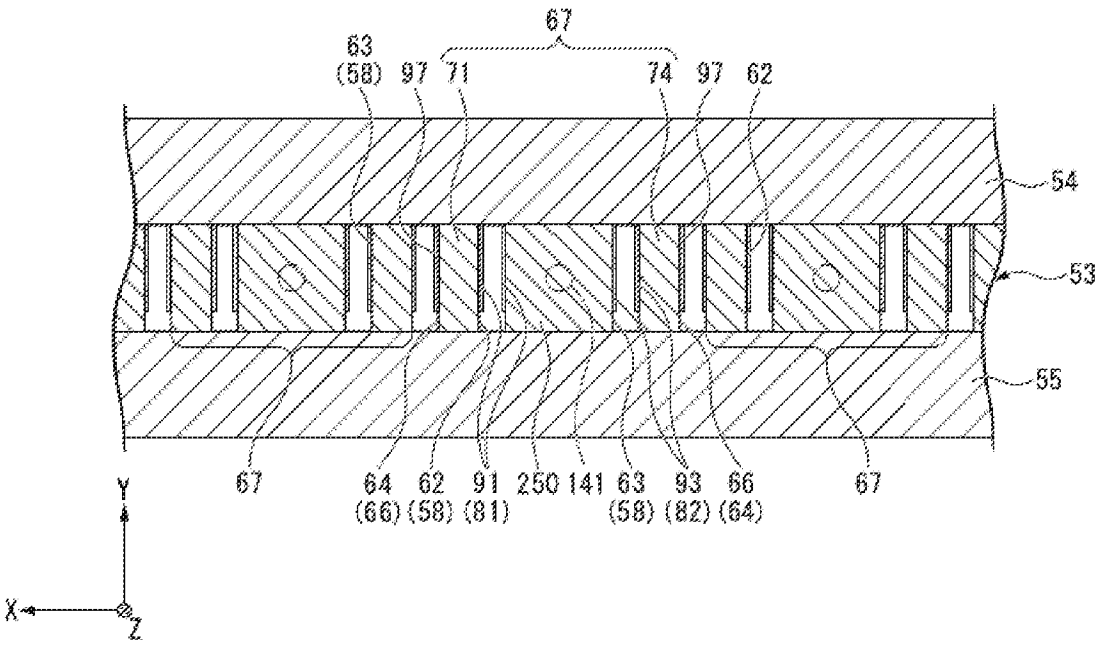
FIG. 17 is a cross-sectional view corresponding to FIG. 9 related to the modified example of the embodiment.

Further, in the embodiment described above, there is described the configuration in which the first ejection channel 62 is surrounded by the pair of drive walls 71, 72, and the second ejection channel 63 is surrounded by the pair of drive walls 73, 74, but this configuration is not a limitation. It is possible to adopt a so-called unilateral drive type in which the upstream drive wall 71 is disposed at the +X side with respect to the first ejection channel 62, and the downstream drive wall 74 is disposed at the −X side with respect to the second ejection channel 63 as, for example, the head chip 50 shown in FIG. 17. In this case, in the actuator plate 53, a portion located between the ejection channels 62, 63 functions as a partition wall 250 for partitioning the ejection channels 62, 63. In other words, in the present embodiment, the upstream drive wall 71 and the downstream drive wall 74 constitute the drive cell 67 for ejecting the ink circulating through one of the circulation channels 58 from corresponding one of the nozzle holes 141 due to the drive of the two drive walls 71, 74.

Other Modified Examples

It should be noted that the technical scope of the present disclosure is not limited to the embodiment described above, but a variety of modifications can be applied within the scope or the spirit of the present disclosure.

For example, in the embodiment described above, the description is presented citing the inkjet printer 1 as an example of the liquid jet recording device, but the liquid jet recording device is not limited to the printer. For example, a facsimile machine, an on-demand printing machine, and so on can also be adopted.

In the embodiment described above, the description is presented citing the configuration (a so-called shuttle machine) in which the inkjet head moves with respect to the recording target medium when performing printing as an example, but this configuration is not a limitation. The configuration related to the present disclosure can be adopted as the configuration (a so-called stationary head machine) in which the recording target medium is moved with respect to the inkjet head in the state in which the inkjet head is fixed.

In the embodiment described above, there is described when the recording target medium P is paper, but this configuration is not a limitation. The recording target medium P is not limited to paper, but can also be a metal material or a resin material, and can also be food or the like.

In the embodiment described above, there is described the configuration in which the liquid jet head is installed in the liquid jet recording device, but this configuration is not a limitation. Specifically, the liquid to be jetted from the liquid jet head is not limited to what is landed on the recording target medium, but can also be, for example, a medical solution to be blended during a dispensing process, a food additive such as seasoning or a spice to be added to food, or fragrance to be sprayed in the air.

In the embodiment described above, there is described the configuration in which the Z direction coincides with the gravitational direction, but this configuration is not a limitation, and it is also possible to set the Z direction along the horizontal direction.

In the embodiments described above, there is described the configuration in which the first direction coincides with the X direction, and the second direction coincides with the Z direction, but this configuration is not a limitation. The first direction and the second direction can be defined differently from the X direction and the Z direction.

In the embodiment described above, there is adopted the configuration in which the second angle θ2 forms the obtuse angle, but this configuration is not a limitation. For example, the second angle θ2 can be an acute angle or the right angle providing there is adopted the configuration in which the second angle θ2 is larger than the first angle θ1.

In the embodiment described above, there is described the configuration in which the common terminals 92, 94 are disposed within the width in the X direction of the ejection channels 62, 63, but this configuration is not a limitation. It is possible for the common terminals 92, 94 to run off the both sides in the X direction with respect to the ejection channels 62, 63.

In the embodiment described above, there is described the configuration in which the channels 62 through 66 are formed by cutting with the dicer 200, but this configuration is not a limitation. The channels 62 through 66 can be formed by sandblasting, laser processing, etching, or the like.

In the embodiment described above, there is described the configuration in which the portions located between the ejection channels 62, 63 and the non-ejection channels 64 through 66 are used as the drive walls 71 through 74, but this configuration is not a limitation. It is sufficient for the drive walls 71 through 74 to respectively partition the ejection channels 62, 63, and to be deformable in a direction of expanding or contracting the ejection channels 62, 63, respectively.

In the embodiment described above, there is presented the description citing the head chip 50 of the circulation type using the first ejection channels 62 as the upstream flow channels and using the second ejection channels 63 as the downstream flow channels as an example, but this configuration is not a limitation. It is possible to adopt a configuration in which the ink located in the first ejection channel 62 and the ink located in the second ejection channel 63 flow toward the coupling channel 120.

In the embodiment described above, there is described the configuration in which the cover plates 54, 55 are respectively disposed on the both surfaces of the actuator plate 53, but this configuration is not a limitation. It is possible to dispose a cover plate provided with the entrance slits and the exit slits on only either one of the principal surfaces of the actuator plate 53.

In the embodiment described above, there is described the configuration in which the interconnections 81 through 84 are laid around on the obverse surface of the actuator plate 53, but this configuration is not a limitation. It is possible to adopt a configuration in which the interconnections 81 through 84 are separately coupled to external wiring on the both surfaces of the actuator plate 53.

In the embodiment described above, there is described the configuration in which the nozzle plate 51 and the feedback plate 52 are separately provided as the end members related to the present disclosure, but this configuration is not a limitation. It is possible for the end member to be integrally formed providing the end member has a configuration provided with at least the coupling channels and the nozzle holes.

Besides the above, it is arbitrarily possible to replace the constituents in the embodiment described above with known constituents within the scope or the spirit of the present disclosure, and it is also possible to arbitrarily combine the modified examples described above.

What is claimed is:

1. A head chip comprising:

an actuator plate provided with a plurality of drive cells arranged in a first direction, a respective drive cell including a first jet channel and a second jet channel which are arranged at an interval in the first direction, and which open on an end surface facing to one side in a second direction crossing the first direction; and an end member which is disposed on the end surface of the actuator plate, and which has a coupling channel for each drive cell, wherein a coupling channel for one drive cell is independent from and does not communicate with a coupling channel of another drive cell, each coupling channel being configured to communicate the first jet channel and the second jet channel of the same coupling channel to each other, and each coupling channel is formed with a jet orifice configured to communicate an inside and an outside of the coupling channel with each other, wherein the first jet channel is surrounded by a pair of first drive walls which are opposed to each other in the first direction, and which deform so as to expand or contract the first jet channel, and the second jet channel is surrounded by a pair of second drive walls which are opposed to each other in the first direction, and which deform so as to expand or contract the second jet channel.

2. The head chip according to claim 1, wherein each drive cell is provided with:

a first non-jet channel which is located on an opposite side to the second jet channel with respect to the first jet channel, and which extends in the second direction;

a second non-jet channel which is located between the first jet channel and the second jet channel, and which extends in the second direction; and a third non-jet channel which is located on an opposite side to the first jet channel with respect to the second jet channel, and which extends in the second direction, one of the first drive walls in pair is a portion located between the first jet channel and the first non-jet channel, the other of the first drive walls in pair is a portion located between the first jet channel and the second non-jet channel, one of the second drive walls in pair is a portion located between the second jet channel and the second non-jet channel, and the other of the second drive walls in pair is a portion located between the second jet channel and the third non-jet channel.

3. The head chip according to claim 2, wherein the first non-jet channel, the second non-jet channel, and the third non-jet channel open on the end surface of the actuator plate, and the end member is provided with a closure part configured to cover the first non-jet channel, the second non-jet channel, and the third non-jet channel.

4. The head chip according to claim 1, wherein a direction crossing the first direction is defined as a thickness direction of the actuator plate when viewed from the second direction, the first jet channel opens at least in a first principal surface in the thickness direction in the actuator plate, the second jet channel opens at least in a second principal surface in the thickness direction in the actuator plate, a first cover plate provided with a first liquid flow channel communicated with the first jet channel is disposed on a side of the first principal surface of the actuator plate, and a second cover plate provided with a second liquid flow channel communicated with the second jet channel is disposed on a side of the second principal surface of the actuator plate.

5. The head chip according to claim 4, wherein the actuator plate is provided with a tail part located on the other side in the second direction with respect to the first jet channel, the second jet channel penetrates the actuator plate in the thickness direction, and the actuator plate is provided with:

a first wiring section formed over an inner surface of the jet channel and the first principal surface in the tail part; and a second wiring section formed over an inner surface of the second jet channel and the first principal surface in the tail part.

6. The head chip according to claim 5, wherein a surface exposed on one side in the second direction of an inner surface of the first jet channel is provided with a first guide surface which constitutes a part of an opening edge of the first jet channel in the first principal surface, and which extends toward the one side in the second direction along a direction toward the second principal surface in the thickness direction, a surface exposed on the one side in the second direction of an inner surface of the second jet channel is provided with:

a second guide surface which extends toward the one side in the second direction along a direction toward the first principal surface in the thickness direction; and an inclined surface which extends toward another side in the second direction along a direction toward the first principal surface in the thickness direction, and which constitutes a part of an opening edge of the second jet channel on the first principal surface, the first wiring section includes:

a first opposed electrode formed in inner side surfaces opposed to each other in the first direction in the inner surface of the first jet channel;

a first terminal formed in the first principal surface in the tail part; and a first coupling part which is formed in the first guide surface, and which is configured to electrically couple the first opposed electrode and the first terminal to each other, and the second wiring section includes:

a second opposed electrode formed in inner side surfaces opposed to each other in the first direction in the inner surface of the second jet channel;

a second terminal formed in the first principal surface in the tail part; and a second coupling part which is formed in the inclined surface, and which is configured to electrically couple the second opposed electrode and the second terminal to each other.

7. A liquid jet head comprising the head chip according to claim 1.

8. A liquid jet recording device comprising the liquid jet head according to claim 7.

9. A head chip comprising:

an actuator plate provided with a first jet channel and a second jet channel which are arranged at an interval in a first direction, and which open on an end surface facing to one side in a second direction crossing the first direction; and an end member which is disposed on the end surface of the actuator plate, and which has a coupling channel configured to couple the first jet channel and the second jet channel to each other and a jet orifice configured to communicate an inside and an outside of the coupling channel with each other, wherein the first jet channel opens at least on a first principal surface of the actuator plate in a thickness direction crossing the second direction when viewed from the first direction, and is provided with a first guide surface which is disposed on a surface exposed at one side in the second direction, which constitutes a part of an opening edge of the first jet channel on the first principal surface, and which extends toward the one side in the second direction along a direction toward the second principal surface in the thickness direction, the second jet channel opens at least on the second principal surface in the thickness direction of the actuator plate, and is provided with a second guide surface which is disposed on a surface exposed at the one side in the second direction, and which extends toward the one side in the second direction along a direction toward the first principal surface in the thickness direction, a first cover plate provided with a first liquid flow channel which is formed at a position opposed to the first guide surface in the thickness direction, and which is communicated with the first jet channel is disposed at a side of the first principal surface of the actuator plate, and a second cover plate provided with a second liquid flow channel which is formed at a position opposed to the second guide surface in the thickness direction, and which is communicated with the second jet channel is disposed at a side of the second principal surface of the actuator plate.

10. A liquid jet head comprising the head chip according to claim 9.

11. A liquid jet recording device comprising the liquid jet head according to claim 10.

* * * * *